US009694412B2

(12) United States Patent
Kohno et al.

(10) Patent No.: US 9,694,412 B2
(45) Date of Patent: Jul. 4, 2017

(54) DRAWING METHOD AND SERVO PRESS SYSTEM

(71) Applicant: AIDA ENGINEERING, LTD., Sagamihara-shi, Kanagawa (JP)

(72) Inventors: Yasuyuki Kohno, Sagamihara (JP); Tadahiro Kondo, Sagamihara (JP); Ryosho Iwamura, Sagamihara (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 159 days.

(21) Appl. No.: 14/204,609

(22) Filed: Mar. 11, 2014

(65) Prior Publication Data

US 2014/0260495 A1 Sep. 18, 2014

(30) Foreign Application Priority Data

Mar. 14, 2013 (JP) ..... 2013-051476

(51) Int. Cl.
*B21D 43/05* (2006.01)
*B21D 22/20* (2006.01)
(Continued)

(52) U.S. Cl.
CPC ..... *B21D 43/05* (2013.01); *B21D 22/20* (2013.01); *B21D 24/00* (2013.01); *B21D 24/02* (2013.01)

(58) Field of Classification Search
CPC ..... B30B 1/14; B30B 15/14; B30B 15/28; B21D 24/14; B21D 24/02; B21D 24/08; B21D 24/10; B21D 22/20; B21D 43/05
See application file for complete search history.

(56) References Cited

U.S. PATENT DOCUMENTS 5,079,489 A * 1/1992 Ishii ..... B30B 1/10 192/131 R
6,945,165 B2 9/2005 Nagae
(Continued)

FOREIGN PATENT DOCUMENTS

CN 1454771 A 11/2003
CN 102152493 A 8/2011
(Continued)

OTHER PUBLICATIONS

Extended European Search Report issued in European Application No. 14156719.8 dated Jun. 17, 2014.
(Continued)

*Primary Examiner* — Peter DungBa Vo
*Assistant Examiner* — John S Lowe
(74) *Attorney, Agent, or Firm* — McDermott Will & Emery LLP

(57) ABSTRACT

The present invention provides a servo press system and a drawing method using the servo press system. The drawing method according to the aspect of the present invention includes: a stopping step of stopping the slide for a first period in a course of a stroke for performing drawing; a keeping step of reducing the die cushion force to below a predetermined die cushion force and keeping the die cushion force for a second period within the first period for which the slide is stopped; and a restarting step of restarting the slide after keeping the die cushion force for the second period, wherein drawing including the stopping step, the keeping step, and the restarting step is performed at least one time in the course of the stroke for performing drawing.

5 Claims, 16 Drawing Sheets

(51) Int. Cl.

| | |
|---|---|
| ***B21D 24/02*** | (2006.01) |
| ***B21D 24/00*** | (2006.01) |

(56) References Cited

U.S. PATENT DOCUMENTS

| | | | | |
|---|---|---|---|---|
| 7,004,006 | B2 | 2/2006 | Nagae | |
| 7,028,611 | B2 | 4/2006 | Nagae | |
| 7,685,860 | B2 * | 3/2010 | Iwashita | B21D 24/02 72/1 |
| 7,963,141 | B2 * | 6/2011 | Nagai | B21D 22/22 72/345 |
| 8,726,801 | B2 | 5/2014 | Asakawa et al. | |
| 8,726,802 | B2 * | 5/2014 | Senda | B23Q 15/18 100/48 |
| 2005/0193904 | A1 | 9/2005 | Nagae | |
| 2008/0141668 | A1 * | 6/2008 | Micklisch | B21D 24/02 60/413 |

FOREIGN PATENT DOCUMENTS

| | | | |
|---|---|---|---|
| EP | 0740968 | A1 | 11/1996 |
| EP | 1741499 | A1 | 1/2007 |
| EP | 1762311 | A2 | 3/2007 |
| JP | 11-254197 | A | 9/1999 |
| JP | 3685615 | B2 | 8/2005 |
| JP | 2008-023535 | A | 2/2008 |

OTHER PUBLICATIONS

Office Action Chinese Patent Application No. 201410089957.8 dated Nov. 15, 2016 with full English translation.

* cited by examiner

DRAWING METHOD AND SERVO PRESS SYSTEM

BACKGROUND OF THE INVENTION

Field of the Invention

The present invention relates to a drawing method and a servo press system, and more particularly, to a technique for deep drawing a material by use of a servo press which transmits a drive force to a slide from a servo motor via a link mechanism.

Description of the Related Art

There has been conventionally proposed an automatic slide position control apparatus for a servo press which enables a servo press with relatively small forming energy to perform forming that requires large energy (Japanese Patent Application Laid-Open No. 11-254197).

The automatic slide position control apparatus for a servo press lowers a slide at a set load, returns (raises) the slide by a given dimension when the slide stops with the forming changed from a dynamic friction to a static friction, and thereafter re-pressurizes the slide to advance the forming with a dynamic friction. By repeating the up-and-down operation of lowering and raising the slide (the lowered amount>the raised amount) as described above until a forming amount reaches a target forming amount, the required forming amount can be ensured even when a servo motor has small output energy.

There has been also proposed a press forming method for a metal plate in which an operation of separating a blank holding plate from a metal plate when a press load reaches a predetermined value or more, and thereafter sandwiching the metal plate between the blank holding plate and a die again by use of a punch and the die to effect forming is performed at least one time in the course of a stroke for performing drawing (Japanese Patent Application Laid-Open No. 2008-23535).

In accordance with the press forming method for a metal plate, a lubricant restores its film thickness by separating the blank holding plate from the metal plate, and slidability is restored when the operation of forming the metal plate by use of the same punch, die and blank holding plate is started again. Therefore, the occurrence of a crack in the metal plate and the occurrence of galling can be suppressed.

Moreover, there has been proposed a vibration forming method for a direct-acting press which performs forming while subjecting a slide to repetitive motion of lowering and raising the slide, in which in a raising step in the repetitive motion, a slide load is returned to a smaller value than that in a lowering step, and held for a predetermined time with a top die in abutment against a material to be processed (Japanese Patent No. 3685615).

In accordance with the vibration forming method for a direct-acting press, marking is performed without separating the top die and the material to be processed during vibration forming, so that displacement between the top die and the material to be processed is not generated between a start time and an end time of the vibration forming. The top die and the material to be processed are not repeatedly contacted and separated, so that noise generated when the top die touches the material to be processed is eliminated, thereby improving a working environment, and suppressing a decrease in the operating life of the die.

SUMMARY OF THE INVENTION

The invention described in Japanese Patent Application Laid-Open No. 11-254197 has a problem that a large amount of kinetic energy is consumed for driving the servo press itself (energy saving cannot be achieved) since the slide is repetitively raised and lowered during the forming operation.

The invention described in Japanese Patent Application Laid-Open No. 2008-23535 has a basic feature that the blank holding plate and the metal plate are temporarily separated, and intends to improve drawing formability by reducing slide resistance. The invention described in Japanese Patent No. 3685615 is the vibration forming method for a direct acting press. None of Japanese Patent Application Laid-Open No. 2008-23535 and Japanese Patent No. 3685615 describes a servo press, and devisal to enable drawing that requires large forming energy by using the servo press, and also enable energy saving and shortening of a press cycle.

The present invention has been made in view of the above circumstances, and an object thereof is to provide a drawing method and a servo press system which enable drawing that requires large forming energy by using a servo press, and also enable energy saving and shortening of a press cycle.

To achieve the above object, an invention according to one aspect of the present invention is a drawing method using a servo press system including a servo press which transmits a drive force to a slide from a servo motor via a link mechanism, and a die cushion apparatus which supports a cushion pad, and generates a die cushion force in the cushion pad, the method including: a stopping step of stopping the slide for a first period in a course of a stroke for performing drawing; a keeping step of reducing the die cushion force to below a predetermined die cushion force and keeping the die cushion force for a second period within the first period in which the slide is stopped; and a restarting step of restarting the slide after keeping the die cushion force for the second period, wherein drawing including the stopping step, the keeping step, and the restarting step is performed at least one time in the course of the stroke for performing drawing.

In accordance with the aspect of the present invention, the slide is stopped for the first period in the course of the stroke for performing drawing, and the die cushion force is reduced to below the predetermined die cushion force and kept for the second period within the first period. Accordingly, drawing that requires large forming energy is enabled by using the servo press, and energy saving and shortening of a press cycle are also enabled. To be more specific, within the first period in which the slide is stopped, the die cushion force is reduced to below the predetermined die cushion force in the forming and kept for the second period. By reducing the die cushion force, a press load is reduced by an amount corresponding to the reduced amount of the die cushion force. Since a blank holding force is reduced at the same time, a tensile stress remaining in a material is also reduced. Thus, the press load is resultantly reduced by a larger amount than the reduced amount of the die cushion force. Accordingly, the press load can be reduced during the slide stop period, and torque applied to the servo motor can be reduced during the slide stop period. A copper loss and an iron loss can be thereby decreased, so that the energy saving is enabled. Since drive energy supplied from a power supply can also be stored up to a desired upper limit within a short time during the slide stop period, the shortening of a press cycle is also enabled, and the servo motor can be driven with large drive torque when the slide is restarted.

In the drawing method according to another aspect of the present invention, the die cushion force may be reduced to a die cushion force at least required for maintaining close contact between a blank holder supported by the cushion pad and a material on the blank holder in the keeping step. By reducing the die cushion force so as not to reach 0 at lowest, the close contact between the blank holder and the material can be maintained. Accordingly, the drawing can be more smoothly performed, and a formed surface can be beautifully finished.

In the drawing method according to yet another aspect of the present invention, the slide may be stopped at a position raised by a predetermined amount after stopping the slide in the stopping step. The residual tensile force acting on the material is reduced more than that of a case in which only the die cushion force is reduced, so that the press load can be reduced, and the energy saving and the shortening of a press cycle can be further advanced.

In the drawing method according to yet another aspect of the present invention, the predetermined amount may be a value larger than 0 mm and smaller than 5 mm. Accordingly, the press load can be reduced, and an amount of drive energy consumed by raising the slide can be suppressed.

In the drawing method according to yet another aspect of the present invention, the servo press may include an energy storage device which supplies electricity to the servo motor, and the first period and the second period may be set corresponding to a period in which an amount of energy storage in the energy storage device is restored to a preset upper limit.

An invention according to yet another aspect of the present invention is a servo press system including: a servo press which transmits a drive force to a slide from a servo motor via a link mechanism, the servo press including a slide position command unit which outputs a slide position command indicative of a position of the slide, a slide position detector which detects the position of the slide, and a slide position control device which controls the servo motor based on the slide position command output from the slide position command unit and the position of the slide detected by the slide position detector; and a die cushion apparatus including a die cushion force generating device which supports a cushion pad and generates a die cushion force in the cushion pad, a die cushion force command unit which outputs a die cushion force command, and a die cushion force control device which controls the die cushion force generating device such that the die cushion force becomes a die cushion force corresponding to the die cushion force command based on the die cushion force command output from the die cushion force command unit, wherein the slide position command unit outputs the slide position command to stop the slide at least one time in a course of a stroke for performing press forming, and the die cushion force command unit outputs a die cushion force command to reduce the die cushion force within a period in which the slide position command to stop the slide is output from the slide position command unit.

By outputting the slide position command to stop the slide from the slide position command unit, the slide is stopped at least one time in the course of the stroke for performing press forming. By outputting a die cushion force command to reduce the die cushion force from the die cushion force command unit within the period in which the slide is stopped, the die cushion force is reduced. Accordingly, a press load during the stop is reduced, energy consumption during the stop is minimized, and drive energy can be stored.

In the servo press system according to yet another aspect of the present invention, the die cushion force command unit may output a die cushion force command corresponding to a die cushion force at least required for maintaining close contact between a blank holder supported by the cushion pad and a material on the blank holder when reducing the die cushion force.

In the servo press system according to yet another aspect of the present invention, when outputting the slide position command to stop the slide at least one time in the course of the stroke for performing press forming, the slide position command unit may output a slide position command indicative of a slide position raised by a predetermined amount from the slide position in the slide position command after outputting the slide position command to stop the slide.

The servo press system according to yet another aspect of the present invention may further include a slide stop detector which detects that the slide is stopped, and an energy storage amount detector which detects an amount of energy storage in an energy storage device that supplies electricity to the servo motor, wherein when the slide stop detector detects that the slide is stopped, the die cushion force command unit may output a die cushion command to reduce the die cushion force in a period from a point of time when the stop is detected until when the energy storage amount in the energy storage device detected by the energy storage amount detector reaches a preset upper limit, and when the energy storage amount detector detects that the energy storage amount reaches the upper limit, the die cushion force command unit may output a die cushion command to increase the reduced die cushion force. Accordingly, timings to reduce and restore the die cushion force can be automated, and a period in which the die cushion force is reduced (the slide stop period) can be minimized Shortening of a press cycle can be thereby enabled.

In the servo press system according to yet another aspect of the present invention, the die cushion force command unit may output a die cushion command to increase the reduced die cushion force after the slide position command to stop the slide is output from the slide position command unit and before a slide position command to restart the slide is output. This is because it is necessary to generate a die cushion force required for drawing when the slide is restarted.

The servo press system according to yet another aspect of the present invention may further include an energy storage amount detector which detects an amount of energy storage in an energy storage device that supplies electricity to the servo motor, wherein when the energy storage amount in the energy storage device detected by the energy storage amount detector reaches a preset lower limit in the course of the stroke for performing press forming, the slide position command unit may output the slide position command to stop the slide. Accordingly, a timing to output the slide position command to stop the slide position can be automated.

In the servo press system according to yet another aspect of the present invention, when the energy storage amount in the energy storage device detected by the energy storage amount detector reaches a preset upper limit after outputting the slide position command to stop the slide, the slide position command unit may output a slide position command to restart the slide. Accordingly, a timing to output the slide position command to restart the slide can be automated.

The servo press system according to yet another aspect of the present invention may further include a slide stop detector which detects that the slide is stopped, and a timer, wherein when the slide stop detector detects that the slide is stopped, the die cushion force command unit may output a die cushion command to reduce the die cushion force for a given time measured by the timer from a point of time when the stop is detected, and thereafter output a die cushion command to increase the reduced die cushion force. Accordingly, timings to reduce and restore the die cushion force can be automated.

In the servo press system according to yet another aspect of the present invention, the slide may include a main slide to which the drive force is transmitted via the link mechanism, and a sub slide which is disposed so as to be relatively raised and lowered with respect to the main slide, the servo press may include a sub slide drive device which reciprocally drives the sub slide in a same direction as the main slide, a sub slide relative position command unit which outputs a relative position command indicative of a relative position of the sub slide to the main slide, and a sub slide position control device which controls the position of the sub slide with respect to the main slide based on the sub slide relative position command output from the sub slide relative position command unit, and when a slide position command to stop the main slide is output from the slide position command unit, the sub slide relative position command unit may output a sub slide relative position command indicative of a relative position for raising the sub slide by a predetermined amount after the slide position command to stop the main slide is output.

Accordingly, by raising the sub slide during the stop of the main slide, the press load can be reduced. Since it is not necessary to use the servo motor for driving the main slide so as to raise and lower the sub slide, the drive energy can also be decreased.

In accordance with the present invention, the drawing operation of stopping the slide driven by the servo motor via the link mechanism for the predetermined period in the course of the stroke for performing drawing, reducing the die cushion force to below the predetermined die cushion force and keeping the die cushion force for the predetermined period within the slide stop period, and thereafter increasing the die cushion force and restarting the slide is performed at least one time in the course of the stroke for performing drawing. The press load can be thereby reduced during the slide stop period. Accordingly, the torque applied to the servo motor can be reduced during the slide stop period. The copper loss and the iron loss can be thereby decreased, so that the efficiency of the servo motor can be temporarily improved. Since the drive energy supplied from the power supply can also be stored up to a desired upper limit within a short time during the slide stop period, the shortening of a press cycle is also enabled, and the servo motor can be driven with large drive torque when the slide is restarted.

DETAILED DESCRIPTION OF THE PREFERRED EMBODIMENTS

Figure 1A:
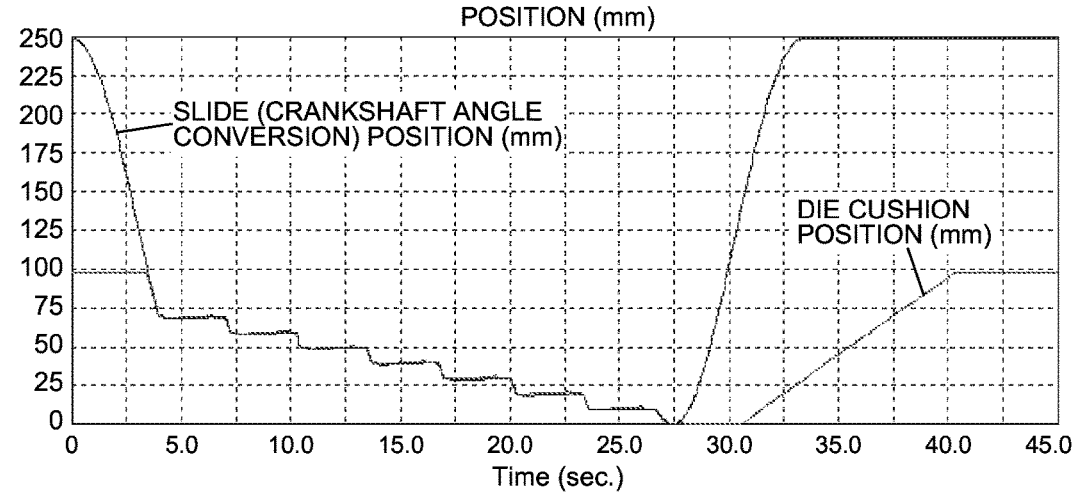
FIGS. 1A to 1C are waveform diagrams illustrating an experiment result of drawing using a drawing method according to a first embodiment.

In the following, preferred embodiments of a drawing method and a servo press system according to the present invention are described in detail according to the accompanying drawings.

<Background of the Present Invention>

When drawing is performed by a servo press, larger forming energy than that of other machining is required. Especially in deep drawing, large forming energy is required, and it is also necessary to drive a servo motor with large drive torque. At this point, in the deep drawing, it is essential to apply a die cushion force. The die cushion force accounts for about 50% of an entire press load.

The servo press which transmits a drive force to a slide from the servo motor via a link mechanism (including a crank mechanism) includes an energy storage device (a capacitor) which supplies electricity to the servo motor. However, in most cases, an amount of drive energy (J) temporarily stored in the capacitor is limited, and power (w) of drive energy supplied from a power supply is also limited due to a reduction in capacity of the used capacitor and a reduction in capacity of the mechanical power supply facility.

The deep drawing has a long drawing stroke, and is started from a high stroke position of a press machine. Thus, servo motor torque (N·m) in association with application of a press load (N) is much larger than that of a case, for example, in which a press load with a similar value is applied around a bottom dead center.

<Problem>

The present applicant has found a problem described below by performing a following experiment. When deep drawing accompanying application of a relatively large press load is performed, drive energy stored in a capacitor is rapidly reduced when the drawing proceeds. Thus, a press is temporarily stopped in a forming process to reduce a forming load, and held on standby until the drive energy is supplied from a power supply and stored.

However, if a die cushion force is not reduced even when the forming load is reduced, a press load of at least 50% of the original load remains. Accordingly, even when forming energy is 0, a large amount of energy is consumed in association with a copper loss proportional to the square of torque (proportional to current) of a servo motor, and an iron loss. Thus, the consumed energy becomes larger than the supplied energy, and the drive energy cannot be recovered. Even when the consumed energy is marginally smaller than the supplied energy and the drive energy is thereby stored, there is a problem that it takes time to store the drive energy due to low power of the storage, and it is thus necessary to extend a stop time, thereby prolonging a time for one process (forming).

In the following, the above problem is specifically described based on a case in which drawing with a stroke of 78 mm was performed by applying a relatively large press load by use of a general servo press with a crank mechanism having a pressurizing capacity of 2,000 kN. A die cushion force applied in the drawing was 200 kN. Forming performed by the servo press in one process was roughly (based on its specifications) 15 kJ.

Figure 14:
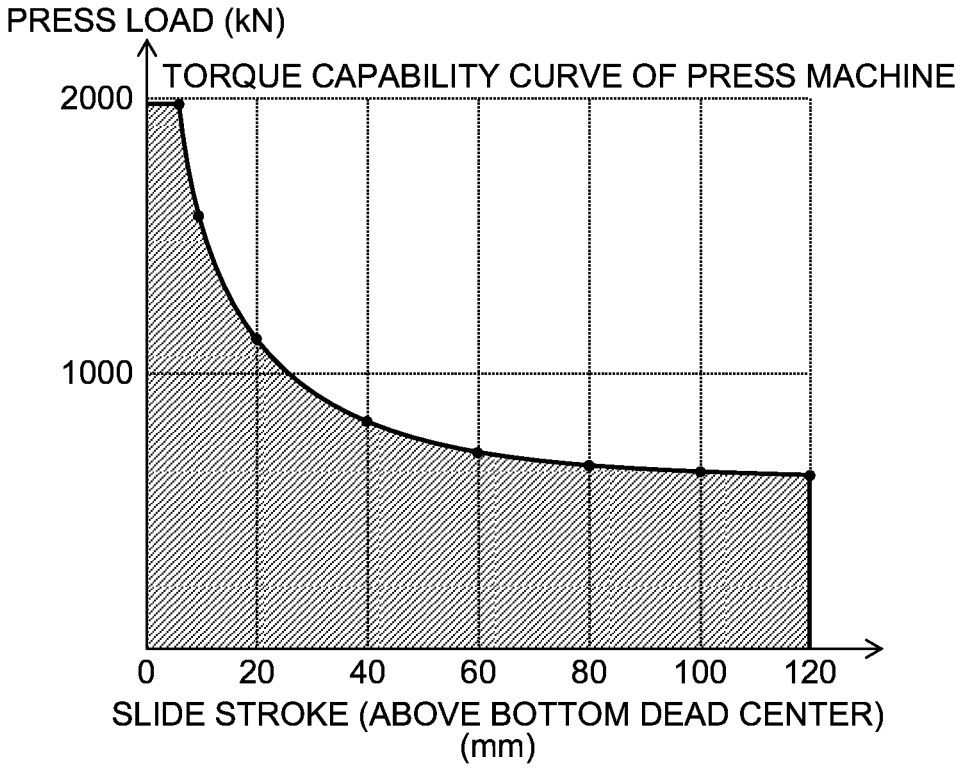
FIG. 14 is a graph illustrating a torque capability curve of a general servo press.

FIG. 14 is a graph illustrating a torque capability curve of a general servo press. The torque capability curve indicates a relationship between a slide stroke and an allowable (allowed to be applied) press load within a limit torque range in view of ensuring the strength of a drive shaft such as a crankshaft.

Substantially constant limit torque is applied on the torque capability curve. That is, for example, a press load of about 720 kN can be applied in view of the shaft strength at a height of 60 mm above a bottom dead center. In other words, when the press load of 720 kN is applied at the height of 60 mm above the bottom dead center, a limit value of about 80 kNm in view of the strength is applied to the crankshaft. The torque value is large, i.e., generally several (2 to 4) times larger than rated torque of a servo motor, and a maximum load is applied to the servo motor.

<Case in which a Slide was Driven at a Relatively Moderate Rate of 5 spm without Stopping>

When the deep drawing is performed by using the servo press, first, it is a premise that the press load is in an allowable range over the entire drawing stroke in the torque capability curve. In this case, the premise is narrowly satisfied.

Next, when a slide was driven at a relatively moderate rate of 5 spm (stroke/minute) by the servo press without stopping, waveform diagrams respectively illustrating a slide position, a press load, a die cushion force, crankshaft drive torque, a press workload, and storage energy as shown in FIGS. 15A to 15D were obtained.

As shown in FIGS. 15A to 15D, the servo press erroneously stopped with an amount of storage energy reaching a lower limit in a forming process after starting the forming.

Figure 15A:
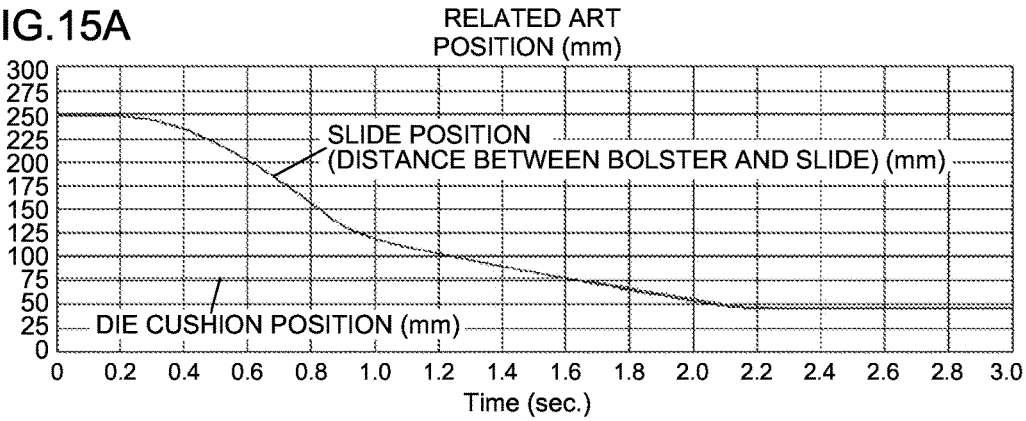
FIGS. 15A to 15D are waveform diagrams illustrating a slide position, a press load, a die cushion force, crankshaft drive torque, a press workload, and storage energy when a slide is driven by a general servo press without stopping.
Figure 15B:
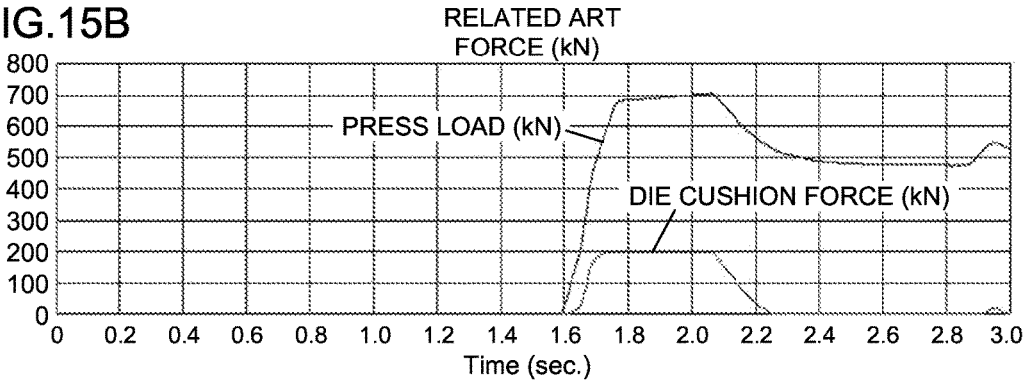
Figure 15C:
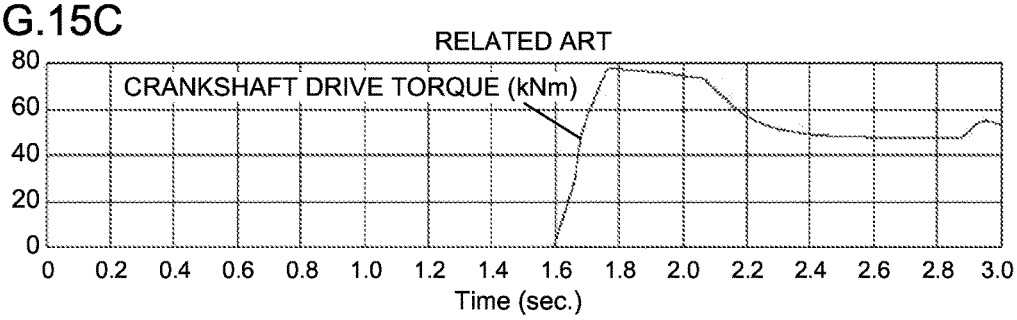
Figure 15D:
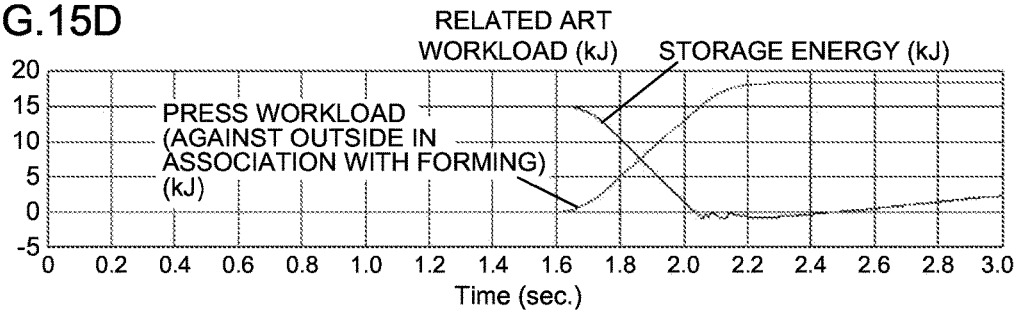

FIG. 15D shows a workload in association with the forming by the servo press, and the amount of storage energy for driving the servo motor of the servo press. Along with an increase in the workload in association with the forming, the storage energy stored in an energy storage device using a capacitor or the like of the servo press was reduced. The servo press erroneously stopped (about 2.1 seconds in FIGS. 15A to 15D) when the slide position was lowered by about 30 mm (FIG. 15A) after starting the forming.

<Case in which the Slide was Temporarily Stopped Before the Above Error Stop so as to Recover the Storage Energy Amount>

FIGS. 16A to 16D are respectively waveform diagrams obtained when the slide was temporarily stopped before the above error stop so as to recover the storage energy amount.

That is, the slide was stopped at a point of about 3 kJ (2.0 seconds in FIGS. 16A to 16D) where the storage energy amount had not reached the lower limit of the servo press yet.

This is to recover the storage energy amount of the servo press by energy supplied to the servo press from a power supply by suspending the forming, and thereby making 0 the workload performed against the outside.

However, the storage energy amount was still on a downward trend after the slide is stopped even though the downward trend was mitigated. After an elapse of about 0.8 seconds from the stop (about 2.85 seconds in FIGS. 16A to 16D), a reduction error of the storage energy amount occurred.

Figure 16A:
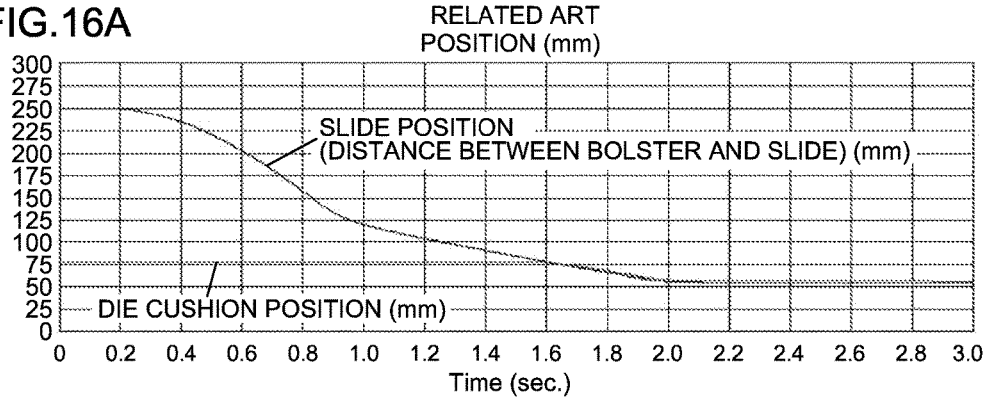
FIGS. 16A to 16D are waveform diagrams illustrating a slide position, a press load, a die cushion force, crankshaft drive torque, a press workload, and storage energy when the slide is temporarily stopped before an error stop occurs when the slide is driven by the general servo press without stopping.
Figure 16B:
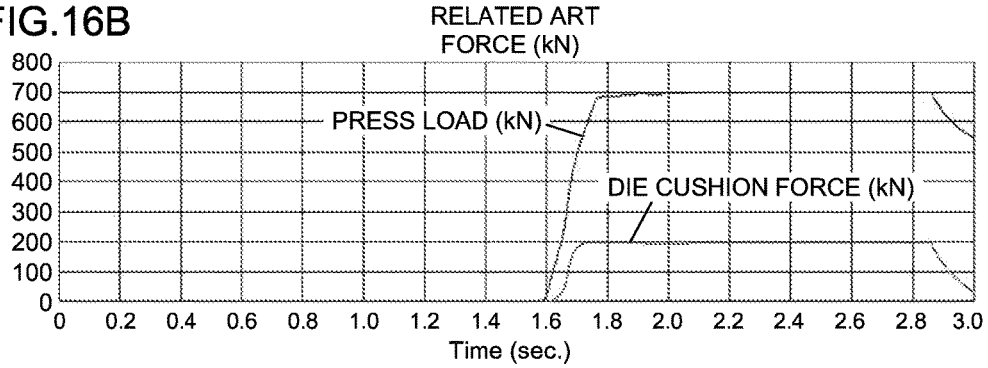
Figure 16C:
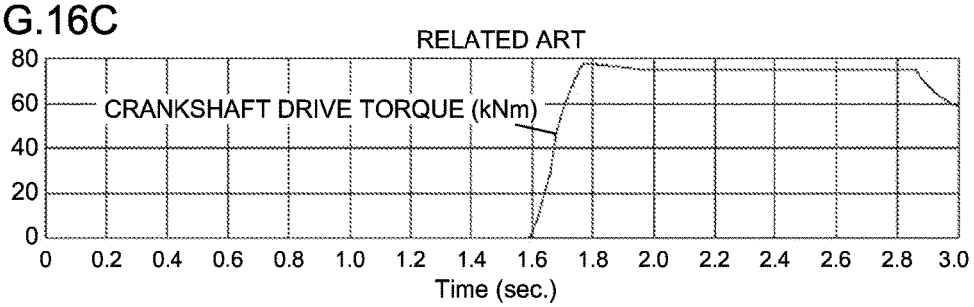
Figure 16D:
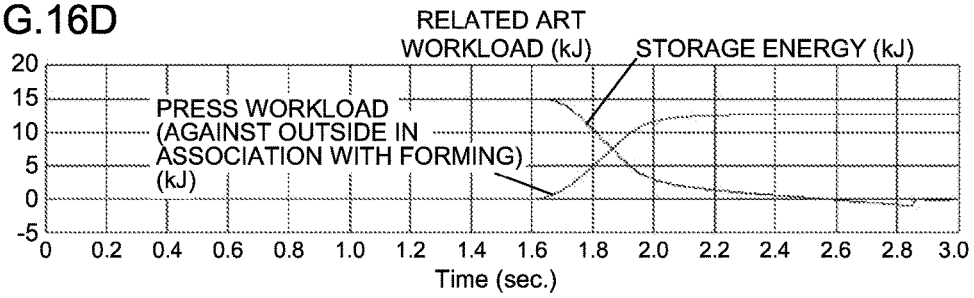

Although there was no workload performed by the servo press against the outside (in association with the forming or acceleration and deceleration) during the slide stop, a press load of about 700 kN was applied (FIG. 16B). Thus, a crankshaft drive torque of about 75 kNm close to the limit value was applied (FIG. 16C). The torque value was proportional to the torque of the servo motor, and about three times larger than the rated torque of the servo motor. At this point, (power of) a loss of the servo motor mainly including a copper loss proportional to the square of the torque exceeded supply electricity supplied from the power supply via a current limiting device (for limiting electricity consumption within a capacity range of the power supply facility). Thus, the above situation was produced.

[Outline of a Drawing Method According to the Present Invention]

In a first embodiment of a drawing method according to the present invention, the die cushion force is reduced and kept for a predetermined period (a second period) within a period (a first period) in which the slide is stopped in the course of the stroke for performing drawing by using the same servo press as above. Also, in the period for which the slide is stopped, the slide is raised by a given amount at the same time as the slide is stopped, and stopped at the raised position.

Subsequently, after the die cushion force is kept for the second period in the reduced state, the slide is restarted. Drawing including stopping the slide, reducing the die cushion force, and restarting the slide as described above is performed at least one time until the slide reaches the bottom dead center in the course of the stroke for performing drawing.

Figure 1B:
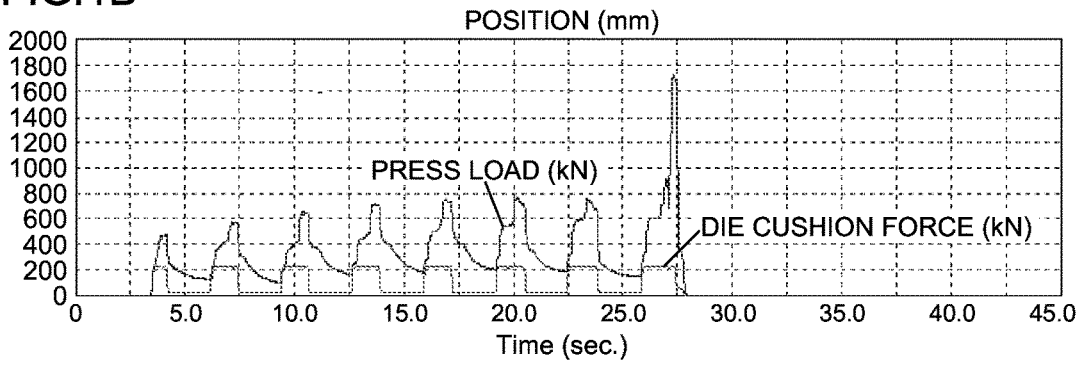
Figure 1C:
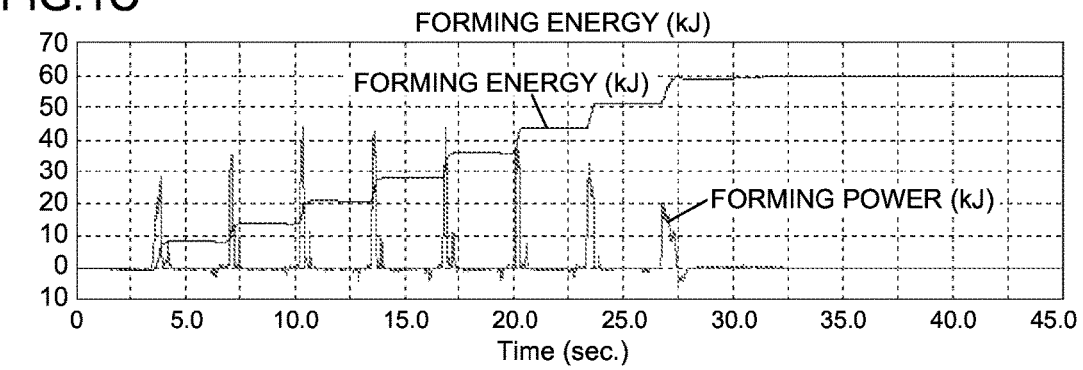

FIGS. 1A to 1C are waveform diagrams illustrating an experiment result of drawing using the drawing method according to the first embodiment. The waveform diagrams respectively show a slide position (mm), a die cushion position (mm), a press load (kN), a die cushion force (kN), forming power (kW), and forming energy (kJ) when deep drawing with a stroke of about 100 mm was performed. In the experiment, the slide was stopped seven times in the course of the stroke for performing drawing. The drawing was performed eight times including the drawing before the first stop.

Figure 2A:
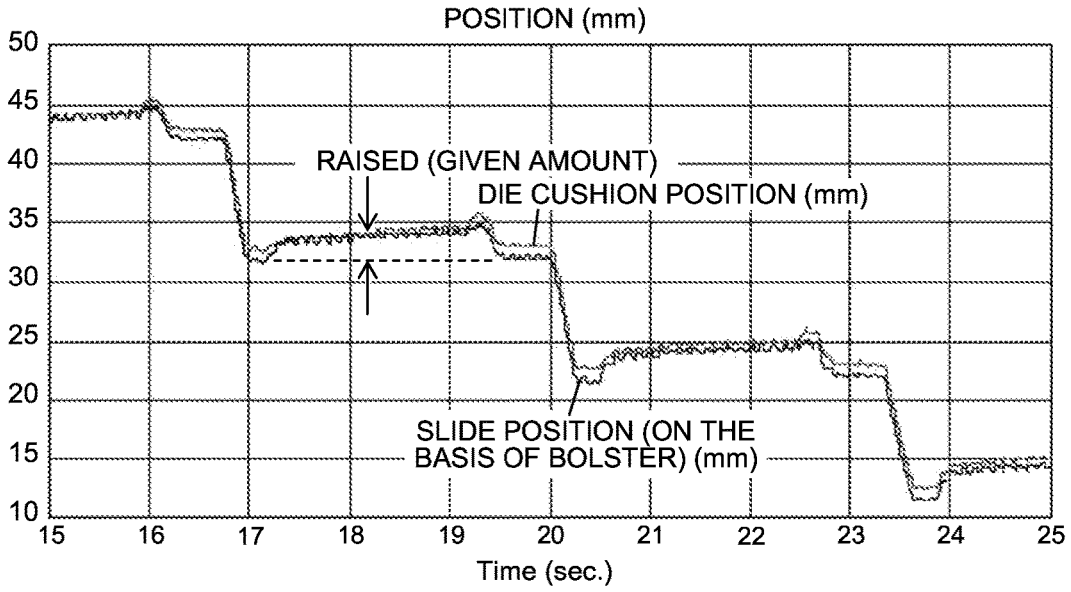
FIGS. 2A and 2B are partially-enlarged diagrams of FIGS. 1A and 1B.
Figure 2B:
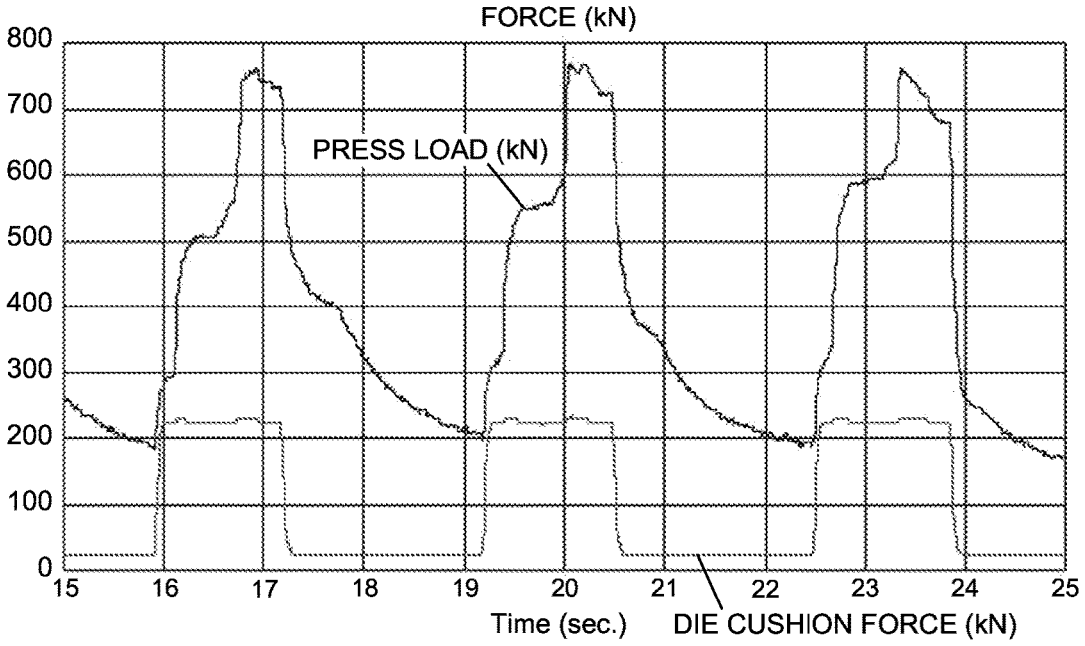

FIGS. 2A and 2B are partially-enlarged diagrams of FIGS. 1A and 1B.

The first embodiment is described based on the experiment. Since the drawing could not be performed with the energy capacity of the servo press, the slide was stopped before the drive energy of the servo press became insufficient in the course of the drawing stroke. As shown in FIG. 2B, the die cushion force was reduced to about 26 kN (that sufficiently maintains close contact between a blank holder and a material, and between the material and a top die) from a state in which a die cushion force of about 230 kN, and a press load of about 720 kN were applied when the slide was stopped.

Immediately after the slide stop, the slide position (the die cushion position) was also raised by a given amount (about 2 mm) (FIG. 2A), to reduce the remaining press load.

While the die cushion force was reduced by 204 kN, the press load was reduced by about 520 kN to about 200 kN (during the stop period). That is, the press load was reduced about 2.5 times more than that of the die cushion force that was reduced by 204 kN.

The die cushion force for maintaining the close contact between the blank holder and the material (about 26 kN in the above example) needs to be larger than a resultant force of gravity applied to the blank holder and a movable mass in conjunction with the blank holder, such as the blank holder, the material, a cushion pin, a cushion pad, and a hydraulic cylinder piston, and an acceleration force obtained by multiplying acceleration when the die cushion position is raised after the stop by the movable mass.

Since the press load was reduced as described above, a current applied to the servo motor for driving the servo press was decreased, so that a voltage stored in the capacitor was recovered (by electricity supplied from the primary power supply).

After that, the die cushion force was restored to a value before the reduction, i.e., about 230 kN, and the slide position was lowered by the raised amount. The slide was then restarted (lowered). The operation was repeated seven times, so that drawing consuming large forming energy of about 60 kJ in one process was enabled.

A second embodiment of the drawing method according to the present invention differs from the first embodiment in that the slide position is maintained without raising the slide by the given amount after the slide is stopped. The other elements are the same as the first embodiment.

Figure 3A:
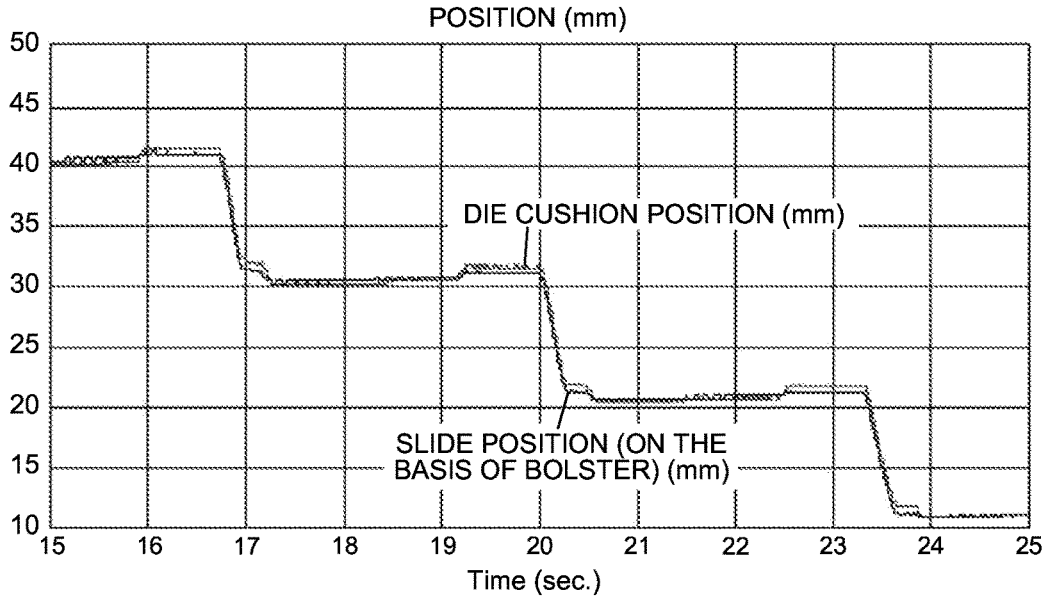
FIGS. 3A and 3B are waveform diagrams illustrating an experiment result of drawing using a drawing method according to a second embodiment.
Figure 3B:
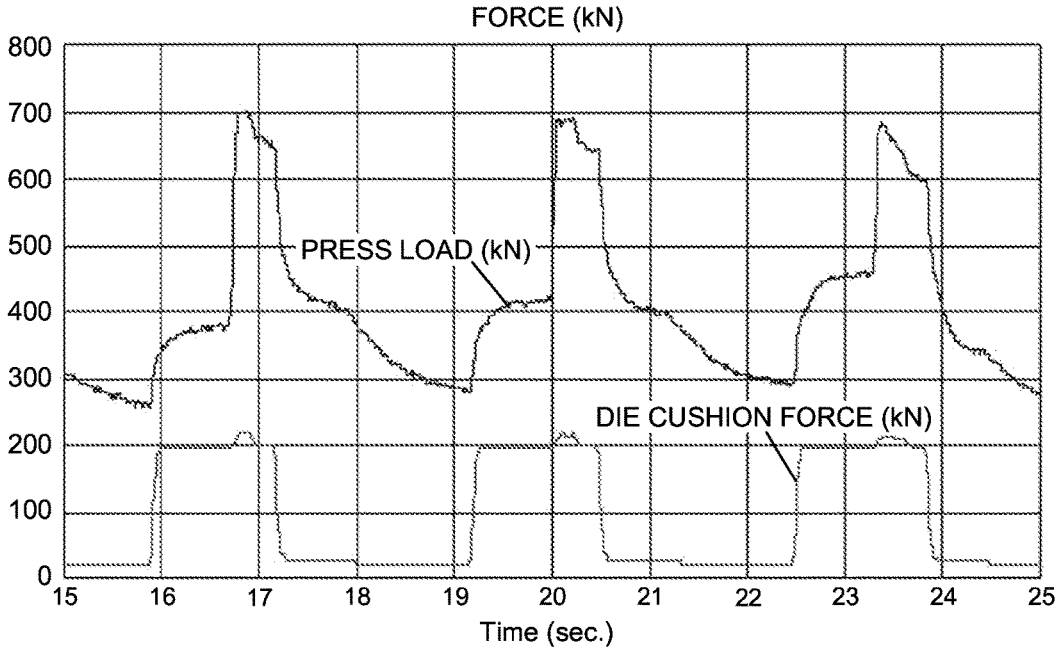

FIGS. 3A and 3B are waveform diagrams illustrating an experiment result of drawing using the drawing method according to the second embodiment. The waveform diagrams shown in FIGS. 3A and 3B correspond to the waveform diagrams in the first embodiment shown in FIGS. 2A and 2B, and respectively show a slide position (mm), a die cushion position (mm), a press load (kN), and a die cushion force (kN) when deep drawing with a stroke of about 100 mm was performed.

The second embodiment is described based on the experiment. As shown in FIG. 3B, the die cushion force was reduced to about 26 kN from a state in which a die cushion force of about 200 kN, and a press load of about 650 kN were applied when the slide was stopped.

While the die cushion force was reduced by 174 kN, the press load was reduced by about 350 kN to about 300 kN (during the stop period). That is, the press load was reduced about two times more than that of the die cushion force that was reduced by 174 kN.

A better effect of reducing the press load was obtained in the first embodiment in which the die cushion force was reduced and the slide position was also raised by the given amount (so as to remove a larger amount of residual stress acting on the material) than in the second embodiment in which only the die cushion force was reduced.

As described using FIGS. 16A to 16D, only by stopping the servo press, the press load per stroke remained and kept acting (although no forming energy is consumed). Thus, a current proportional to large servo motor drive torque was applied to the servo motor so as to support the press load particularly acting at a high stroke position, so that the capacitor voltage was reduced by the copper loss and the iron loss (was not recovered).

Meanwhile, according to the drawing method according to the first and second embodiments of the present invention, the die cushion force is reduced during the slide stop period, and the press load is thereby reduced by a larger amount than the influence of the reduction in the die cushion force. Accordingly, the torque applied to the servo motor is significantly decreased, thereby reducing the copper loss and the iron loss to enable energy saving. Since the supplied energy is sufficiently larger than the consumed energy, the storage amount of the drive energy can be recovered.

When the slide position is also raised after reducing the die cushion force, the press load can be further reduced, and an effect of recovering the drive energy of the servo press can be improved, so that an effect of recovering the drive energy in a short stop time can be obtained. A press cycle can also be shortened by decreasing the stop time.

Servo Press System

First Embodiment

Figure 4:
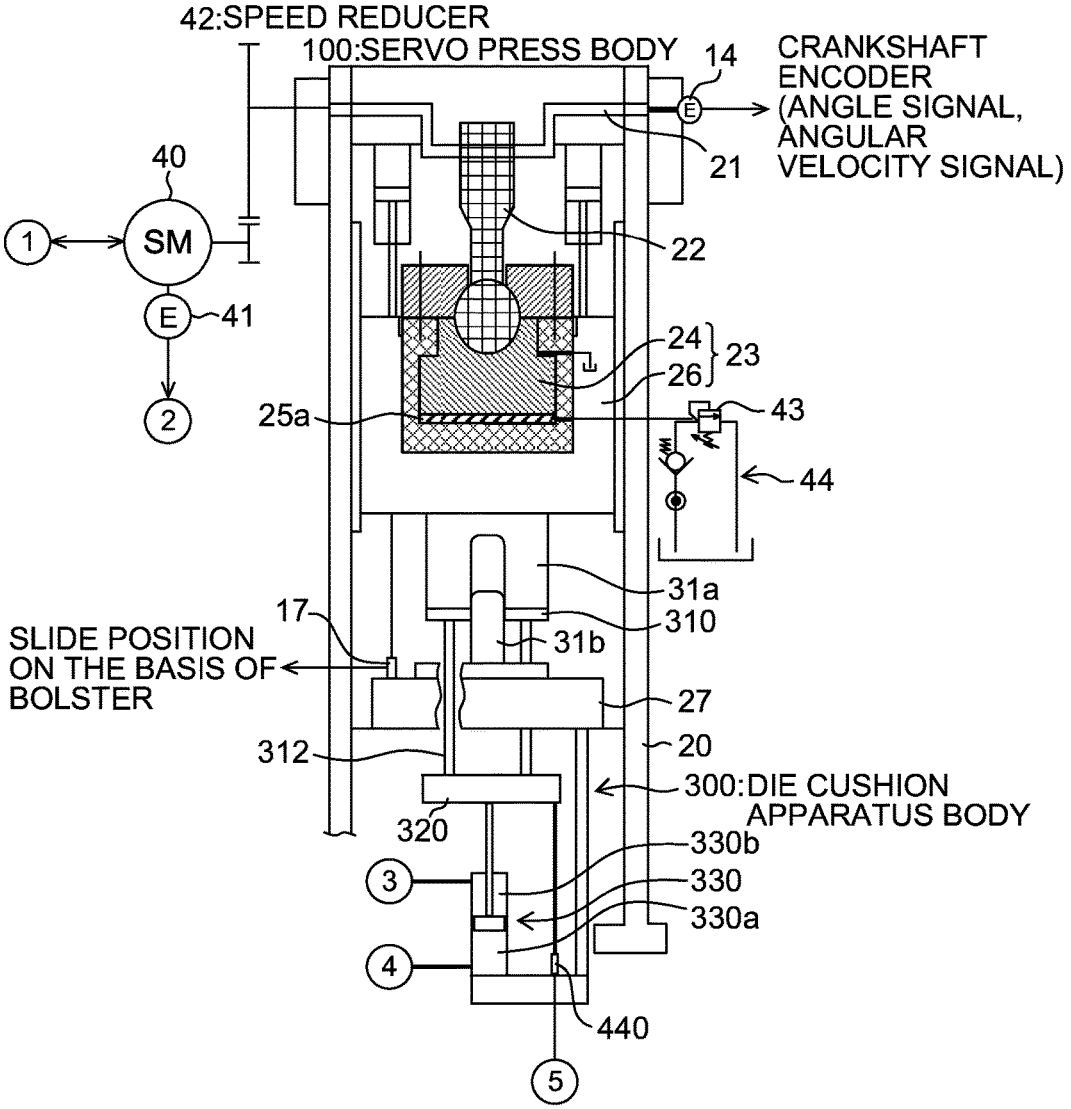
FIG. 4 is a view illustrating a servo press body and a die cushion apparatus body applied to a first embodiment of a servo press system according to the present invention.
Figure 5:
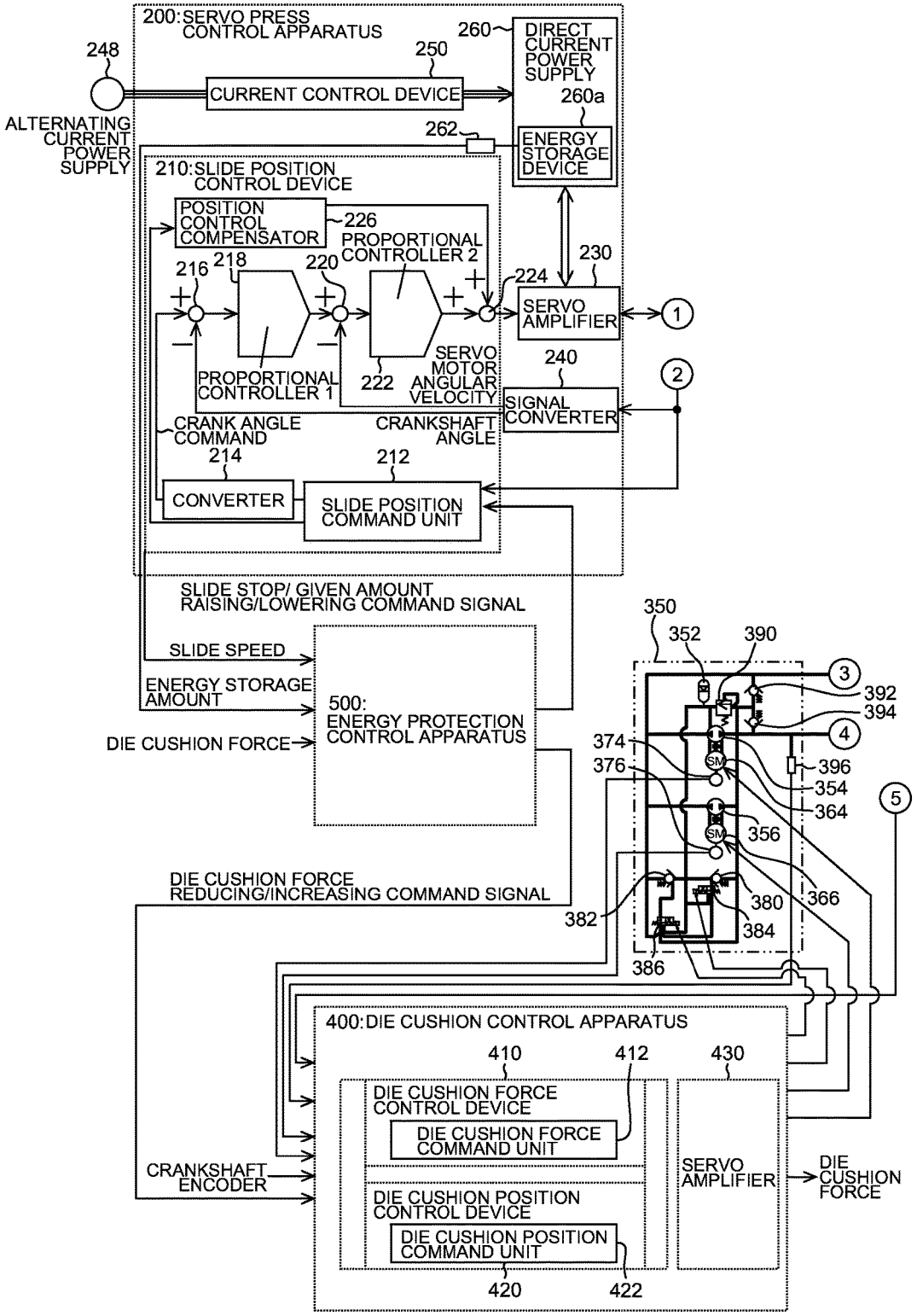
FIG. 5 is a block diagram illustrating a servo press control apparatus, a die cushion control apparatus, and an energy protection control apparatus for controlling the servo press body and the die cushion apparatus body shown in FIG. 4.

FIGS. 4 and 5 are system configuration diagrams illustrating a first embodiment of a servo press system according to the present invention.

As shown in FIGS. 4 and 5, the servo press system according to the first embodiment mainly includes a servo press (a servo press body 100 and a servo press control apparatus 200), a die cushion apparatus (a die cushion apparatus body 300 and a die cushion control apparatus 400), and an energy protection control apparatus 500. Although the energy protection control apparatus 500 is independent, the energy protection control apparatus 500 may also be included in the servo press control apparatus 200 or the die cushion control apparatus 400.

<Servo Press>

As shown in FIG. 4, the servo press body 100 is a crank-type servo press including a column (frame) 20, a crankshaft 21, a connecting rod 22, a slide 23 (a main slide 24 and a sub slide 26), and a bolster 27.

The main slide 24 is guided so as to be able to reciprocate in a straight direction (a vertical direction in FIG. 4) by a guide section provided in the column 20.

The main slide 24 and the sub slide 26 constitute a cylinder piston mechanism (a hydraulic cylinder). The main slide 24 corresponds to a cylinder of the hydraulic cylinder, and the sub slide 26 corresponds to a piston of the hydraulic cylinder. The sub slide 26 is arranged so as to be able to reciprocate in the same direction as the straight direction in which the main slide 24 moves, with respect to the main slide 24.

A distal end portion of the connecting rod 22 provided on the crankshaft 21 is coupled to the main slide 24. A rotational drive force is transmitted to the crankshaft 21 via a servo motor 40 and a speed reducer 42. When the crankshaft 21 rotates, the main slide 24 is moved in the vertical direction in FIG. 4 together with the sub slide 26 by the drive force applied via the crankshaft 21 and the connecting rod 22.

An overload removal device 44 including a relief valve 43 is connected to a descent-side hydraulic chamber 25*a* of the hydraulic cylinder.

A crankshaft encoder 14 which detects an angular velocity and an angle of the crankshaft 21 is provided on the crankshaft 21. A slide position detector 17 which detects a slide position on the basis of the bolster is provided between the sub slide 26 and the bolster 27.

A top die (a die) 31*a* is mounted to the sub slide 26, and a bottom die (a punch) 31*b* is mounted onto the bolster 27. The die (the top die 31*a* and the bottom die 31*b*) in the present embodiment is used for forming a product having a hollow cup-like shape (a drawing shape) whose upper side is closed.

As shown in FIG. 5, the servo press control apparatus 200 mainly includes a slide position control device 210, a servo amplifier 230, a current control device 250, and a direct current power supply 260.

The slide position control device 210 includes a slide position command unit 212, a converter 214 which converts a slide position command to a crank angle command, subtractors 216 and 220, proportional controllers 218 and 222, an adder 224, and a position control compensator 226.

Control by the servo press control apparatus 200 is basically performed by controlling driving of the servo motor 40 so as to cause a detected crankshaft angle to follow the slide position command (the crank angle command corresponding to the slide position command) output from the slide position command unit 212.

That is, the slide position command output from the slide position command unit 212 is converted to the crank angle command by the converter 214, and output to a positive input of the subtractor 216. A signal converter 240, which converts to a crankshaft angle a detection signal of a servo motor encoder 41 that detects a rotation amount of the servo motor 40, applies a crankshaft angle detection signal to a negative input of the subtractor 216. The subtractor 216 outputs a deviation between the two inputs to the proportional controller 218. The proportional controller 218 amplifies the input deviation, and outputs the amplified deviation to a positive input of the subtractor 220 as a first manipulated variable signal.

The signal converter 240, which converts to a servo motor angular velocity the detection signal of the servo motor encoder 41 that detects the rotation amount of the servo motor 40, applies a servo motor angular velocity signal to a negative input of the subtractor 220. The subtractor 220 outputs a deviation between the two inputs to the proportional controller 222. The proportional controller 222 amplifies the input deviation, and outputs the amplified deviation to the adder 224 as a second manipulated variable signal.

The slide position command unit 212 also outputs the slide position command to the position control compensator 226. The position control compensator 226 outputs a command to reduce a slide position deviation (the slide position command−the slide position) in operation.

The adder 224 outputs an addition signal obtained by adding the two inputs to the servo amplifier 230 as a torque command signal for the servo motor 40.

The servo press control apparatus 200 computes the torque command signal for controlling torque of the servo motor 40 as described above, outputs the computed torque command signal to the servo motor 40 via the servo amplifier 230, and controls the position of the slide 23 in the servo press body 100 driven by the servo motor 40.

The position control compensator 226 is not always required in order to achieve the present invention. However, the position control compensator 226 is preferably provided so as to improve controllability.

The direct current power supply 260 includes an energy storage device (a capacitor) 260*a*. The direct current power supply 260 converts an alternating current supplied from an alternating current power supply 248 via the current control device 250 to a direct current, stores the direct current in the capacitor 260*a* as drive energy of the servo motor 40, and supplies the drive energy stored in the capacitor 260*a* to the servo amplifier 230. Although the capacitor is used as the energy storage device 260*a* in the present embodiment, the energy storage device 260*a* is not limited thereto. A device other than the capacitor, e.g., a secondary battery may also be used.

<Die Cushion Apparatus>

As shown in FIGS. 4 and 5, the die cushion apparatus includes the die cushion apparatus body 300, a die cushion drive apparatus 350, and the die cushion control apparatus 400.

As shown in FIG. 4, the die cushion apparatus body 300 includes a blank holder (a blank holding plate) 310 arranged between the top die 31*a* and the bottom die 31*b*, a cushion pad 320 which supports the blank holder 310 via a plurality of cushion pins 312, and a hydraulic cylinder (a die cushion force generating device) 330 which supports the cushion pad 320 and generates a die cushion force in the cushion pad 320.

The die cushion drive apparatus 350 is composed of a hydraulic circuit which controls pressure oil flowing into and out of an ascent-side hydraulic chamber 330*a* and a descent-side hydraulic chamber 330*b* of the hydraulic cylinder 330. The die cushion drive apparatus 350 mainly includes an accumulator 352, hydraulic pumps/motors 354 and 356, servo motors 364 and 366 connected to rotating shafts of the hydraulic pumps/motors 354 and 356, encoders 374 and 376 which respectively detect angular velocities of drive shafts of the servo motors 364 and 366, pilot operation check valves 380 and 382, electromagnetic direction switching valves 384 and 386, a relief valve 390, check valves 392 and 394, and a pressure detector 396.

The accumulator 352 is set at a low gas pressure and functions as a tank. One ports of the hydraulic pumps/motors 354 and 356 are connected to the ascent-side hydraulic chamber (a cushion pressure generating-side hydraulic chamber) 330*a* of the hydraulic cylinder 330, and the other ports thereof are connected to the descent-side hydraulic chamber (a pad-side hydraulic chamber) 330*b* of the hydraulic cylinder 330.

The electromagnetic direction switching valves 384 and 386 are respectively switch-controlled to apply a pilot pressure to the pilot operation check valves 380 and 382. The electromagnetic direction switching valves 384 and 386 thereby function to forcibly discharge pressure oil acting on the side of the ascent-side hydraulic chamber 330*a* and the hydraulic pumps/motors 354 and 356 to a low-pressure (to which the accumulator is connected) line, or forcibly suck the pressure oil from the low-pressure line. The electromagnetic direction switching valves 384 and 386 are not used in a normal operation (function), and used in maintenance or the like. The relief valve 390 is provided so as to prevent damage to the hydraulic devices in the occurrence of an abnormal pressure (the occurrence of a sudden abnormal pressure when the die cushion force cannot be controlled).

A pressure applied to the cushion pressure generating-side hydraulic chamber 330*a* of the hydraulic cylinder 330 is detected by the pressure detector 396. Angular velocities of the servo motors 364 and 366 are respectively detected by the encoders 374 and 376.

[Principle of Die Cushion Force Control]

The die cushion force can be expressed as the product of the pressure of the cushion pressure generating-side hydraulic chamber 330*a* of the hydraulic cylinder 330, and a cylinder area. Thus, the control of the die cushion force means control of the pressure of the cushion pressure generating-side hydraulic chamber 330*a* of the hydraulic cylinder 330.

Now, when a die cushion force generating-side sectional area of the hydraulic cylinder is represented by A,
a die cushion force generating-side volume of the hydraulic cylinder is represented by V,
a die cushion force is represented by P,
torques of the servo motors are represented by Ta, Tb,
inertia moments of the motors are represented by Ia, Ib,
viscosity resistance coefficients of the motors are represented by DMa, DMb,
friction torques of the motors are represented by fMa, fMb,
displacement volumes of the hydraulic pumps/motors are represented by Qa, Qb,
a force applied to a piston rod of the hydraulic cylinder from the slide is represented by F,
a pad velocity generated when pressed by the slide is represented by v,
an inertia mass of the piston rod of the hydraulic cylinder and the pad is represented by M,
a viscosity resistance coefficient of the hydraulic cylinder is represented by DS,
a frictional force of the hydraulic cylinder is represented by fS,
angular velocities of the servo motors rotating when pushed by the pressure oil are represented by ωa, ωb,
a modulus of elasticity of volume of the pressure oil is represented by K, and
proportional constants are represented by k1, k2,
a static behavior can be expressed by [Expression 1] and [Expression 2] described below.

$$P=\int K((v\cdot A-k1(Qa\cdot\omega a+Qb\cdot\omega b))/V)dt \quad \text{[Expression 1]}$$

$$Ta=k2\cdot PQa/(2\pi),Tb=k2\cdot PQb/(2\pi) \quad \text{[Expression 2]}$$

A dynamic behavior can be expressed by [Expression 3] and [Expression 4] in addition to [Expression 1] and [Expression 2].

$$PA-F=M\cdot dv/dt+DS\cdot v+fS \quad \text{[Expression 3]}$$

$$Ta-k2\cdot PQa/(2\pi)=Ia\cdot d\omega a/dt+DMa\cdot\omega a+fMa$$

$$Tb-k2\cdot PQb/(2\pi)=Ib\cdot d\omega b/dt+DMb\cdot\omega b+fMb \quad \text{[Expression 4]}$$

The expressions [Expression 1] to [Expression 4] described above means that a force transmitted to the hydraulic cylinder 330 from the slide 23 via the cushion pad 320 compresses the cushion pressure generating-side hydraulic chamber 330*a* of the hydraulic cylinder 330, and generates the die cushion force. At the same time, the die cushion force causes the hydraulic pumps/motors 354 and 356 to act as a hydraulic motor. When rotating shaft torque generated in the hydraulic pumps/motors 354 and 356 is balanced with drive torque of the servo motors 364 and 366, the servo motors 364 and 366 are rotated, thereby suppressing an increase in the pressure.

In short, the die cushion force generated from the hydraulic cylinder 330 is determined according to the drive torque of the servo motors 364 and 366.

As shown in FIG. 5, the die cushion control apparatus 400 includes a die cushion force control device 410, a die cushion position control device 420, and a servo amplifier 430.

When the slide 23 is in a region of a non-forming process, the die cushion control apparatus 400 is switched from a die cushion force control state by the die cushion force control device 410 to a die cushion position control state by the die cushion position control device 420 based on a crank angle signal input from the crankshaft encoder 14 which detects the angular velocity and the angle of the crankshaft 21. When the slide 23 is in a region of a forming process, the die cushion control apparatus 400 is switched from the die cushion position control state to the die cushion force control state.

The die cushion force control device 410 includes a die cushion force command unit 412 which outputs a die cushion force command. In the case of the die cushion force control state, a torque command signal for controlling the torque of the servo motors 364 and 366 is computed based on the die cushion force command output from the die cushion force command unit 412, and the die cushion force calculated by the product of the pressure of the cushion pressure generating-side hydraulic chamber 330*a* of the hydraulic cylinder 330 detected by the pressure detector 396, and the cylinder area. The computed torque command signal is output to the servo motors 364 and 366 via the servo amplifier 430. The drive torque of the servo motors 364 and 366 is controlled such that the calculated die cushion force becomes a die cushion force corresponding to the die cushion force command. Detection signals of the encoders 374 and 376 which respectively detect the angular velocities of the drive shafts of the servo motors 364 and 366 are used for compensation for stably controlling the die cushion force.

The die cushion position control device 420 includes a die cushion position command unit 422 which outputs a die cushion position command. In the case of the die cushion position control state, the servo motors 364 and 366 are controlled based on the die cushion position command output from the die cushion position command unit 422, and a position detection value detected by a die cushion position detector 440. The pressure oil is supplied to the ascent-side hydraulic chamber 330*a* or the descent-side hydraulic chamber 330*b* of the hydraulic cylinder 330 from the hydraulic pumps/motors 354 and 356.

A position in an extension and retraction direction of the piston rod of the hydraulic cylinder 330 is thereby controlled, so that a position in an ascending and descending direction of the cushion pad 320 (a die cushion position) is controlled.

<Energy Protection Control Apparatus>

As shown in FIG. 5, a slide speed signal is input to the energy protection control apparatus 500 from the slide position control device 210. A detection signal indicative of an amount of energy storage (e.g., a voltage value of the capacitor 260*a*) is also input to the energy protection control apparatus 500 from an energy storage amount detector 262 which detects the amount of energy storage in the energy storage device (the capacitor) 260*a*. The slide speed signal can be calculated by computing a slide speed from the detection signal of the servo motor encoder 41 (from the crankshaft angle and the crankshaft angular velocity computed from the detection signal), or differentiating a slide position detection signal output from the slide position detector 17.

A signal indicative of the die cushion force based on a value obtained by multiplying the pressure detected by the pressure detector 396 by the sectional area of the ascent-side hydraulic chamber 330*a* of the hydraulic cylinder is also input to the energy protection control apparatus 500 from the die cushion control apparatus 400.

The energy protection control apparatus 500 outputs a stop command signal to stop the slide 23, and a command signal to raise by a given amount or lower the slide 23 to the slide position command unit 212 based on the input signals. The energy protection control apparatus 500 also outputs a command signal to reduce or increase the die cushion force to the die cushion control apparatus 400.

Figure 6:
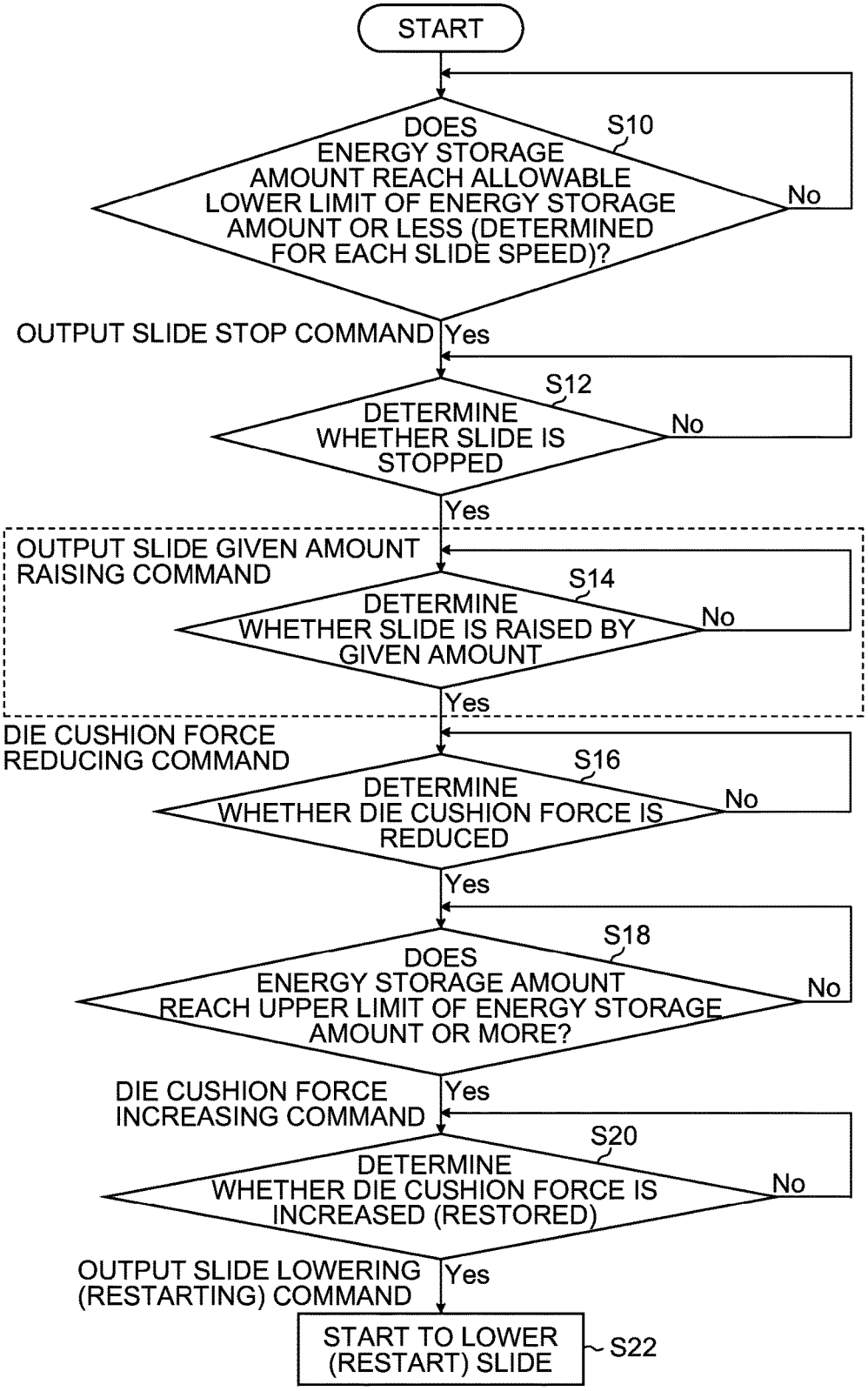
FIG. 6 is a flowchart used for explaining the operation of the energy protection control apparatus or the like shown in FIG. 5.
Figure 7A:
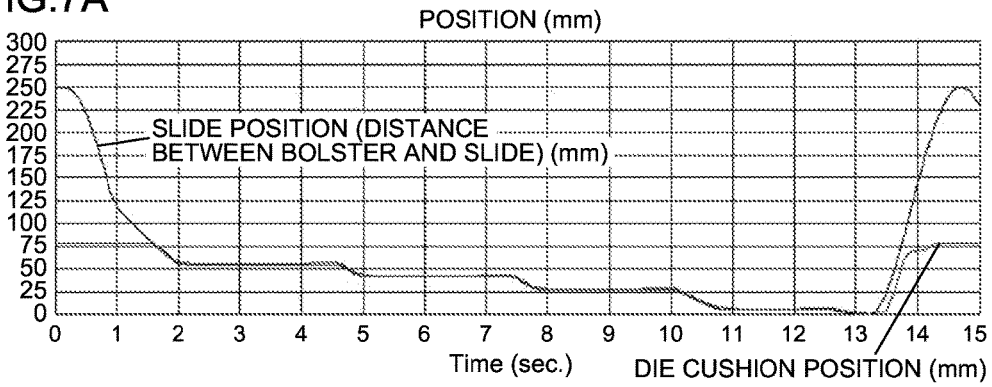
FIGS. 7A to 7D are waveform diagrams illustrating an experiment result of drawing using the servo press system according to the first embodiment.
Figure 7B:
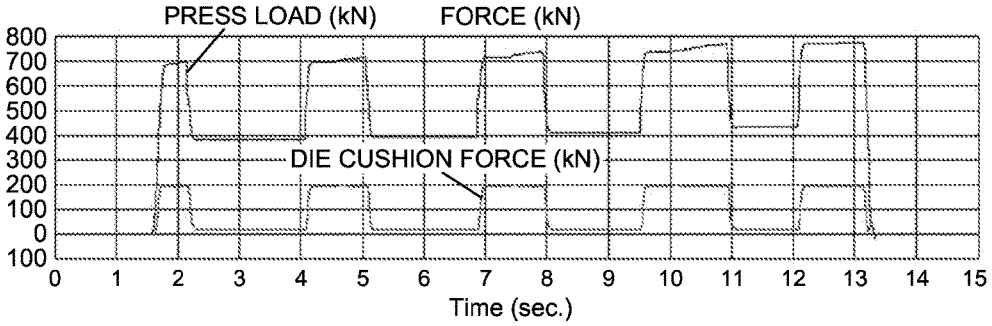
Figure 7C:
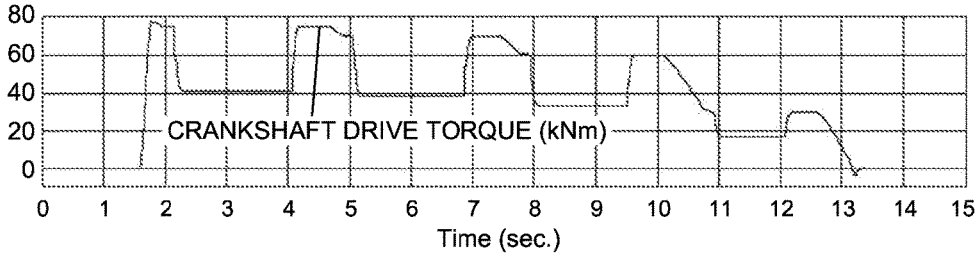
Figure 7D:
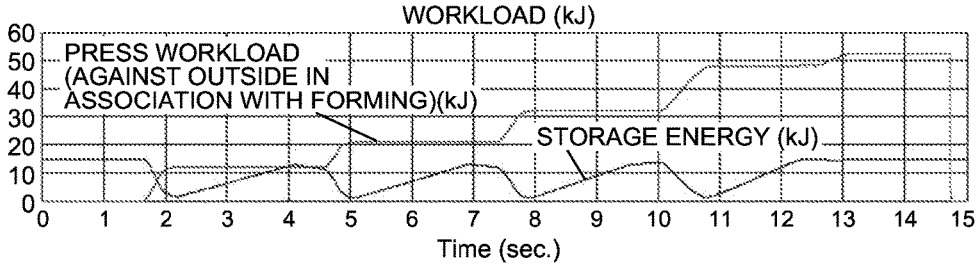

Next, the operation of the energy protection control apparatus 500 is described based on a flowchart shown in FIG. 6, and respective waveform diagrams for one cycle (about 15 seconds in the present embodiment) shown in FIGS. 7A to 7D.

It is assumed that the slide 23 is in the course of a stroke for performing drawing in one cycle. In the course of the stroke for performing drawing, the die cushion apparatus 300 is in the die cushion force control state.

During the drawing, the energy stored in the energy storage device 260*a* is consumed in a larger amount than a supply amount supplied via the current control device 250. Thus, the storage energy in the energy storage device 260*a* is gradually decreased (a lower-side waveform in FIG. 7D).

The energy protection control apparatus 500 monitors the energy storage amount stored in the energy storage device 260*a* based on the detection signal input from the energy storage amount detector 262, and determines whether the energy storage amount reaches an allowable lower limit of the energy storage amount or less (step S10 in FIG. 6). The allowable lower limit of the energy storage amount is preferably determined for each slide speed such that the allowable lower limit is increased as the slide speed is higher. This is because, as the slide speed is higher, it takes longer until the slide is stopped after the slide stop command is output, and the slide is thus lowered through inertia to correspondingly consume extra energy.

When the energy storage amount is detected to reach the allowable lower limit or less, the energy protection control apparatus 500 outputs a slide stop command to the slide position command unit 212. The slide position command unit 212 holds the current slide position command at a given value according to the input slide stop command, and the slide 23 is controlled to be stopped by following the held value.

There are some methods for holding the slide position command at a given value. By employing a method of holding the position command value when the slide stop command is output, the slide is most smoothly (with smallest deceleration) stopped. However, an inertia descent distance to the stop is increased. Meanwhile, by employing a method of holding an actual position when the slide stop command is output, the slide is stopped most quickly. However, the deceleration is increased and the slide is stopped undershooting the stop position command value once. In the present embodiment, a method of holding the slide position command at an intermediate value is employed.

The energy protection control apparatus 500 determines whether the slide 23 is stopped after outputting the slide stop command (step S12). The slide 23 can be determined to be stopped by a slide stop detector which detects that the slide speed input from the slide position control device 210 becomes 0, or that a change in the crank angle signal of the crankshaft encoder 14 becomes 0.

When determining that the slide 23 is stopped (in a case of "Yes"), the energy protection control apparatus 500 outputs a slide given amount raising command to the slide position command unit 212. A given amount for raising the slide 23 is a value determined in a range of 0<the given amount<5 mm. If the given amount is small, a press load removal effect is low. If the given amount is 5 mm or more, large energy is consumed for raising the slide 23.

Subsequently, the energy protection control apparatus 500 determines whether the slide 23 is raised by the given amount (step S14). When determining that the slide 23 is raised by the given amount (in a case of "Yes"), the energy protection control apparatus 500 outputs a die cushion force reducing command to the die cushion control apparatus 400. While step S14 in which the slide given amount raising command is output and the slide is determined to be raised by the given amount is performed in order to improve the press load removal effect, step S14 may also be omitted. The waveform diagrams illustrating an experiment result in FIGS. 7A to 7D show a case in which the processing in step S14 was omitted.

When the die cushion force reducing command is input from the energy protection control apparatus 500, the die cushion force command unit 412 within the die cushion force control device 410 holds the die cushion force command at a small value. In this case, the die cushion force command value is to be reduced to 40 kN, which is a command value capable of maintaining close contact between the blank holder 310 and a material on the blank holder 310. The die cushion force is reduced from 200 kN to 40 kN by following the die cushion force command value (a lower-side waveform in FIG. 7B). Along therewith, the press load is also reduced by (the total of) the reduced amount of the die cushion force and a reduced amount of a residual tensile force generated in the material (an upper-side waveform in FIG. 7B).

The energy protection control apparatus 500 determines whether the die cushion force is reduced based on the signal indicative of the die cushion force input from the die cushion control apparatus 400 (step S16). When determining that the die cushion force is reduced (in a case of "Yes"), the energy protection control apparatus 500 subsequently determines whether the storage energy in the energy storage device 260*a* reaches an upper limit of the energy storage amount (whether the energy storage amount is recovered) (step S18).

That is, the torque of the servo motor 40 is reduced to about half (FIG. 7C) at the same time as the reduction in the press load. The electricity supplied via the current control device 250 thereby exceeds a loss mainly including a copper loss of the servo motor 40, and the energy storage amount in the energy storage device 260*a* is recovered (the lower-side waveform in FIG. 7D).

When the storage energy is determined to reach the upper limit (in a case of "Yes"), the energy protection control apparatus 500 outputs a die cushion force increasing command to the die cushion control apparatus 400.

When the die cushion force increasing command is input from the energy protection control apparatus 500, the die cushion force command unit 412 within the die cushion force control device 410 outputs a die cushion force command value for increasing the reduced die cushion force (40 kN) to the original die cushion force (200 kN). The die cushion force is increased from 40 kN to 200 kN by following the die cushion force command value (the lower-side waveform in FIG. 7B). Along therewith, the press load is also increased (the upper-side waveform in FIG. 7B).

The energy protection control apparatus 500 determines whether the die cushion force is increased (restored) to the original die cushion force (200 kN) after outputting the die cushion force increasing command (step S20). When determining that the die cushion force is increased (in a case of "Yes"), the energy protection control apparatus 500 outputs a slide lowering command to the slide position command unit 212.

The slide position command unit 212 releases the held slide position command (the stop command) based on the input slide lowering command, and outputs a slide position command to lower the slide 23. Accordingly, the slide 23 starts to be lowered (is restarted) by following the slide position command to lower the slide 23, and the forming is continued (step S22).

The processing from step S10 to step S22 described above is repeated until the slide 23 reaches the bottom dead center.

Second Embodiment

Figure 8:
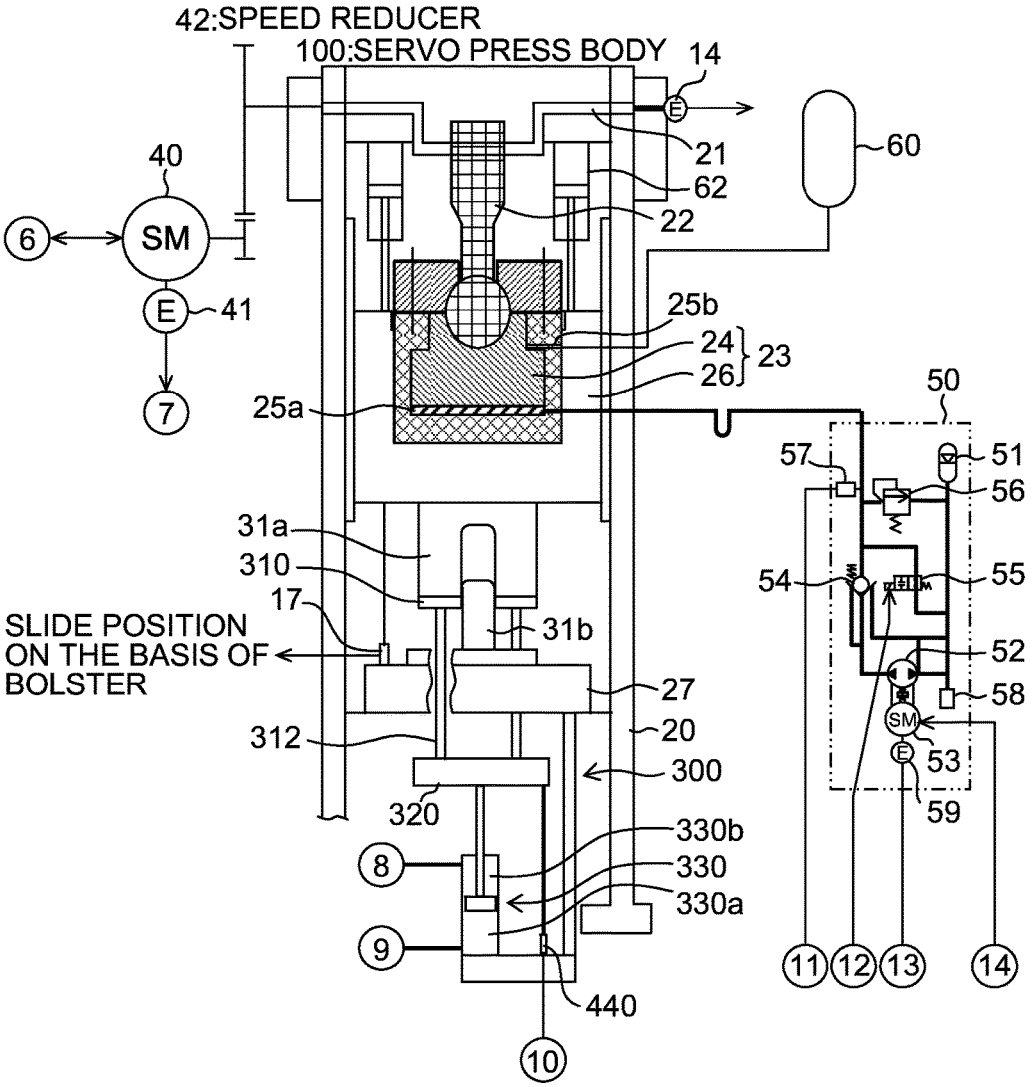
FIG. 8 is a view illustrating a servo press body and a die cushion apparatus body applied to a second embodiment of the servo press system according to the present invention.
Figure 9:
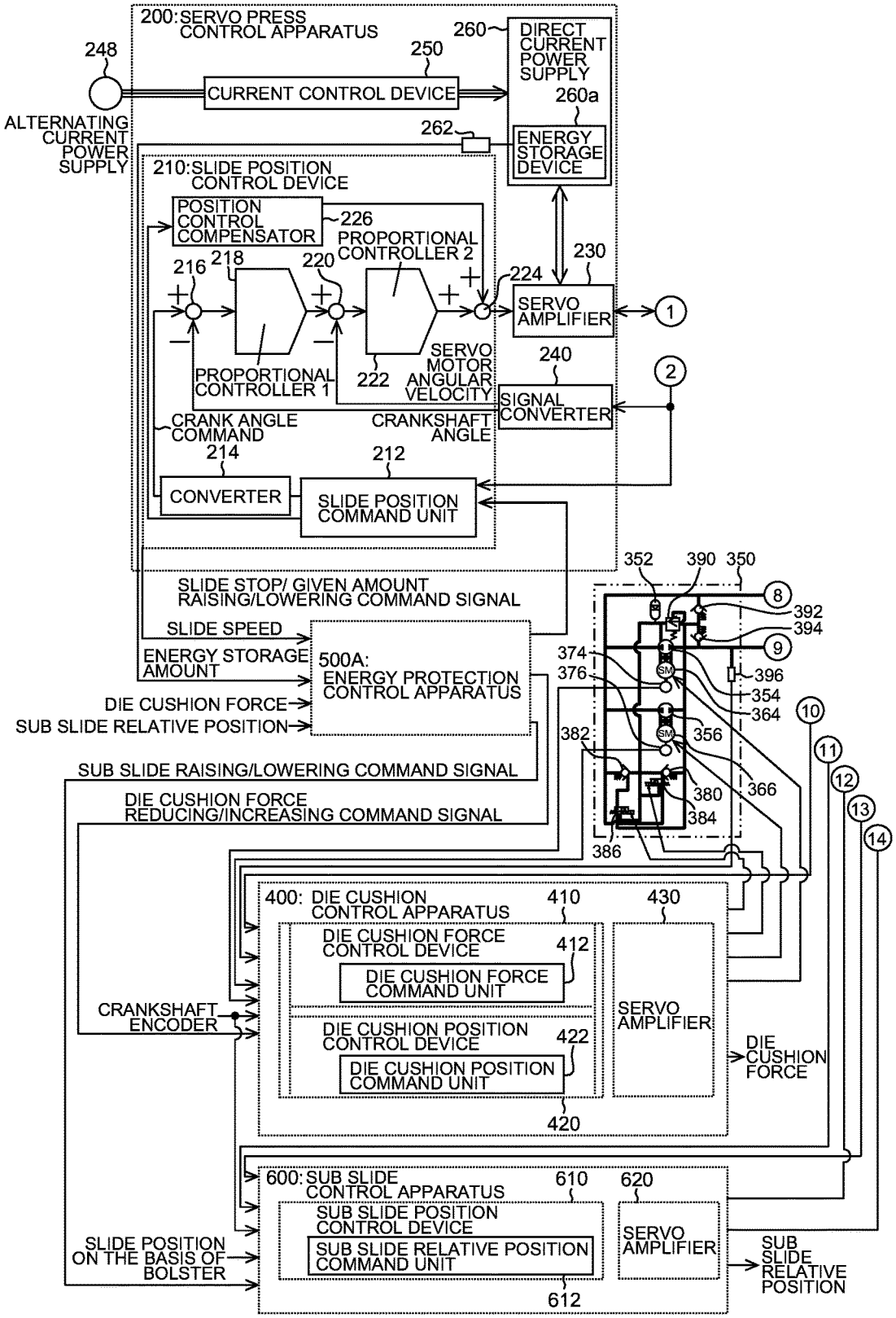
FIG. 9 is a block diagram illustrating a servo press control apparatus, a die cushion control apparatus, an energy protection control apparatus, and a sub slide control apparatus for controlling the servo press body and the die cushion apparatus body shown in FIG. 8.

FIGS. 8 and 9 are system configuration diagrams illustrating a second embodiment of the servo press system according to the present invention.

As shown in FIGS. 8 and 9, the servo press system according to the second embodiment mainly includes the servo press (the servo press body 100, the servo press control apparatus 200, and a sub slide control apparatus 600), the die cushion apparatus (the die cushion apparatus body 300 and the die cushion control apparatus 400), and an energy protection control apparatus 500A. Portions common to those in the first embodiment shown in FIGS. 4 and 5 are assigned the same reference numerals, and the detailed description thereof is omitted.

<Servo Press>

As shown in FIGS. 8 and 9, the servo press according to the second embodiment differs from the servo press according to the first embodiment in that a sub slide drive device 50 is provided instead of the overload removal device 44 of the servo press in the first embodiment, and the sub slide control apparatus 600 is also added.

The slide 23 including the main slide 24 and the sub slide 26 constitutes the hydraulic cylinder as described above. Press oil supplied to the descent-side hydraulic chamber 25*a* from the sub slide drive device 50 acts as a power source for relatively lowering the sub slide 26 with respect to the main slide 24 (the distal end of the connecting rod). A force generated by supplying an air pressure to an ascent-side hydraulic chamber 25*b* from an air tank 60, or a thrust force of a balancer cylinder 62 may be used as a power source for relatively raising the sub slide 26 with respect to the distal end of the connecting rod.

As shown in FIG. 8, the sub slide drive device 50 mainly includes an accumulator 51, a hydraulic pump/motor 52, a servo motor 53 connected to a rotating shaft of the hydraulic pump/motor 52, a pilot operation check valve 54, an electromagnetic valve 55, and a relief valve 56.

The accumulator 51 is set at a gas pressure of about 1 to 5 kg/cm$^2$. The accumulator 51 functions as a tank by accumulating pressure oil in a lower-pressure state (a substantially constant low pressure) of about 10 kg/cm$^2$ or less.

One port of the hydraulic pump/motor 52 is connected to the descent-side hydraulic chamber 25*a* of the hydraulic cylinder constituted by the main slide 24 and the sub slide 26 via the pilot operation check valve 54, and the other port thereof is connected to the accumulator 51. The hydraulic pump/motor 52 is rotationally operated in a forward direction (a side for pressurizing the descent-side hydraulic chamber 25*a*) and a reverse direction (a side for depressurizing the descent-side hydraulic chamber 25*a*) according to torque applied from the servo motor 53 and a hydraulic force acting on the two ports.

The pilot operation check valve 54 can keep constant a pressure of the descent-side hydraulic chamber 25*a* even when the servo motor 53 is in a non-load state (a state in which the torque is 0) so as to reduce a load on the servo motor 53 (plus the hydraulic pump/motor 52) in a region of a non-forming process (at least the upper half of the slide stroke) in one press (slide) cycle operation. The sub slide 26 is held at a descent end (limit) with respect to the main slide 24. For the pilot operation, for example, a pressure applied to the port of the hydraulic pump/motor 52 on the descent-side hydraulic chamber 25*a* side is used.

The electromagnetic valve 55 functions to forcibly remove the pressure applied to the descent-side hydraulic chamber 25*a*. The electromagnetic valve 55 is not used in a normal operation (function), and used in maintenance (before disassembly of the machine) or the like.

The relief valve 56 functions to release the pressure oil to the substantially constant low pressure side (the accumulator 51) when an unexpected abnormal pressure is applied to the descent-side hydraulic chamber 25*a* separately from a normally generated pressure.

The pressure applied to the port of the hydraulic pump/motor 52 on the descent-side hydraulic chamber 25*a* side (the pressure of the descent-side hydraulic chamber 25*a* when the pilot operation check valve 54 is opened), and a pressure applied to the port of the hydraulic pump/motor 52 on the accumulator side are respectively detected by pressure detectors 57 and 58. An angular velocity of the servo motor 53 is also detected by an encoder 59.

The sub slide control apparatus 600 shown in FIG. 9 controls a position of the sub slide 26 (a relative position to the main slide 24) via the above sub slide drive device 50. The sub slide control apparatus 600 mainly includes a sub slide position control device 610 and a servo amplifier 620. The sub slide position control device 610 includes a sub slide relative position command unit 612.

The sub slide control apparatus 600 performs control by outputting a torque command signal proportional to a deviation between a relative position command signal of the sub slide 26 with respect to the main slide 24 output from the sub slide relative position command unit 612 and a relative position detection signal, to the servo motor 53 (FIG. 8) of the sub slide drive device 50 via the servo amplifier 620 so as to cause the relative position detection signal to follow the relative position command signal.

Here, a position of the main slide 24 (a position of the connecting rod distal end) can be detected by the crankshaft angle detected by the crankshaft encoder 14. The slide position detector 17 also detects the slide position on the basis of the bolster (the height of a die mounting surface of the sub slide 26). Thus, the relative position detection signal indicative of the relative position of the sub slide 26 to the main slide 24 can be detected based on the respective detection signals of the crankshaft encoder 14 and the slide position detector 17.

A detection signal of the encoder 59 which detects the angular velocity of the drive shaft of the servo motor 53 is used for compensation for stably controlling the relative position of the sub slide 26 according to the sub slide relative position command under application of the press load.

Since the sub slide control apparatus 600 controls the relative position of the sub slide 26 to the main slide 24, the control is not affected by inertia of the crank mechanism and the entire slide. Thus, a variable speed response of the slide is significantly improved as compared to a case in which the position of the main slide 24 (the connecting rod distal end) is subjected to servo control by the servo motor 40.

In the present embodiment, the control for raising by a given amount and lowering the sub slide 26 is performed by the sub slide control apparatus 600 while the main slide 24 is controlled to be stopped.

The energy protection control apparatus 500A shown in FIG. 9 differs from the energy protection control apparatus 500 in that a command signal to raise or lower the sub slide 26 is further output to the sub slide control apparatus 600 as compared to the energy protection control apparatus 500 shown in FIG. 5.

The detection signals indicative of the slide speed and the energy storage amount are input to the energy protection control apparatus 500A from the servo press control apparatus 200. The signal indicative of the die cushion force is input to the energy protection control apparatus 500A from the die cushion control apparatus 400. The signal indicative of the sub slide relative position is also input to the energy protection control apparatus 500A from the sub slide control apparatus 600.

The energy protection control apparatus 500A outputs a command signal to stop or lower (restart) the slide 23 to the slide position command unit 212, outputs a command signal to reduce or increase the die cushion force to the die cushion control apparatus 400, and further outputs a command signal to raise or lower the sub slide 26 to the sub slide control apparatus 600 based on the input signals.

Figure 10:
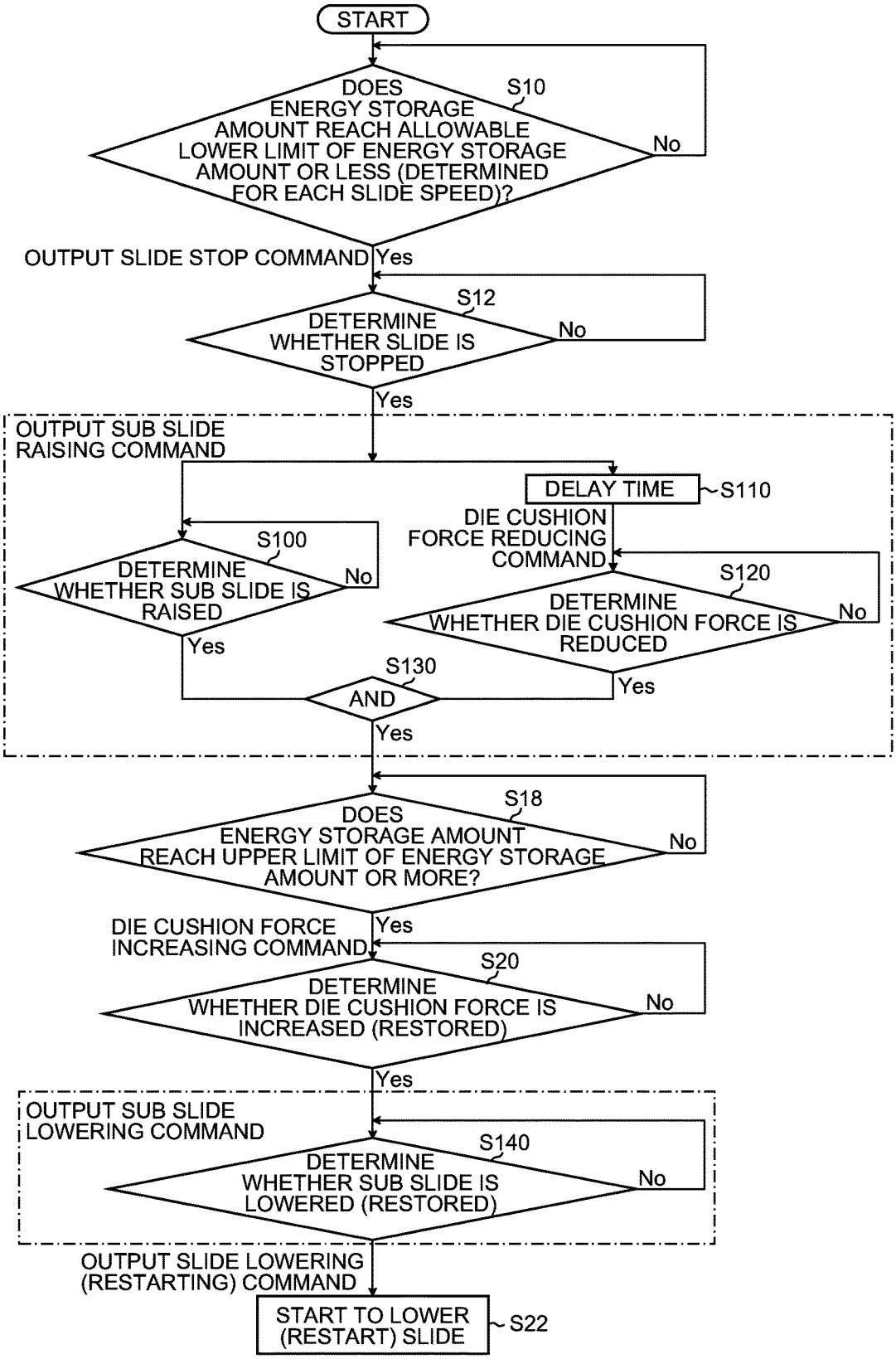
FIG. 10 is a flowchart used for explaining the operation of the energy protection control apparatus or the like shown in FIG. 9.

Next, the operation of the energy protection control apparatus 500A is described based on a flowchart shown in FIG. 10 and respective waveform diagrams shown in FIGS. 11A to 11E. Portions common to those in FIG. 6 are assigned the same step numbers in the flowchart shown in FIG. 10, and the detailed description thereof is omitted.

The flowchart shown in FIG. 10 differs from the flowchart shown in FIG. 6 in that the processing in steps S100 to S130 is executed instead of steps S14 and S16, and step S140 is also added between steps S20 and S22.

In FIG. 10, when determining that the slide 23 is stopped in step S12, the energy protection control apparatus 500A outputs a sub slide raising command to raise the sub slide 26 by a given amount to the sub slide control apparatus 600. The energy protection control apparatus 500A outputs a die cushion force reducing command to the die cushion control apparatus 400 after an elapse of a given time from outputting the sub slide raising command in step S110.

The sub slide raising command is a command to raise the sub slide 26 by 1.5 mm. It is not necessarily essential (not always necessary) that the die cushion force is reduced at a delayed timing. However, when the two operations are performed at the same time, the reduction in the die cushion force momentarily precedes the rise in the sub slide, and the sub slide 26 is correspondingly lowered by a recovered amount of frame elastic deformation, thereby possibly causing a forming defect (due to an insufficient blank holding force). The die cushion force is preferably reduced at a delayed timing so as to avoid the above problem. When the sub slide is raised by 1.5 mm, the press load is further reduced to half of that of the case in which the sub slide is not raised. This is because the residual tensile force acting on the material is further reduced as compared to the case in which only the die cushion force is reduced.

When the sub slide raising command is input from the energy protection control apparatus 500A, the sub slide relative position command unit 612 within the sub slide position control device 610 switches the sub slide relative position command to a value for raising the sub slide 26 by the given amount, and holds the value. In this case, the sub slide 26 temporarily stopped by the slide stop command is stopped at a position raised by 1.5 mm from the temporarily-stopped position (the position of the die mounting surface) by controlling the sub slide drive device 50 to follow the sub slide relative position command to raise the sub slide 26 by the given amount.

Figure 11A:
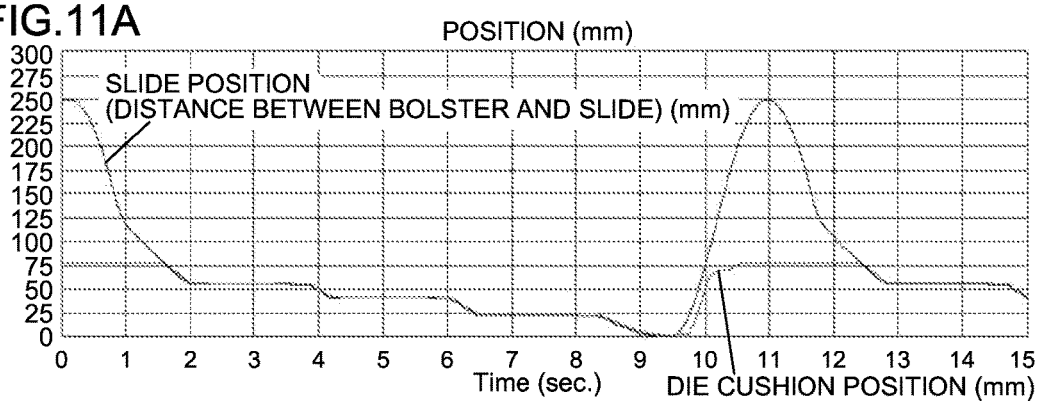
FIGS. 11A to 11E are waveform diagrams illustrating an experiment result of drawing using the servo press system according to the second embodiment, in which a sub slide is raised by 1.5 mm after stop.
Figure 11B:
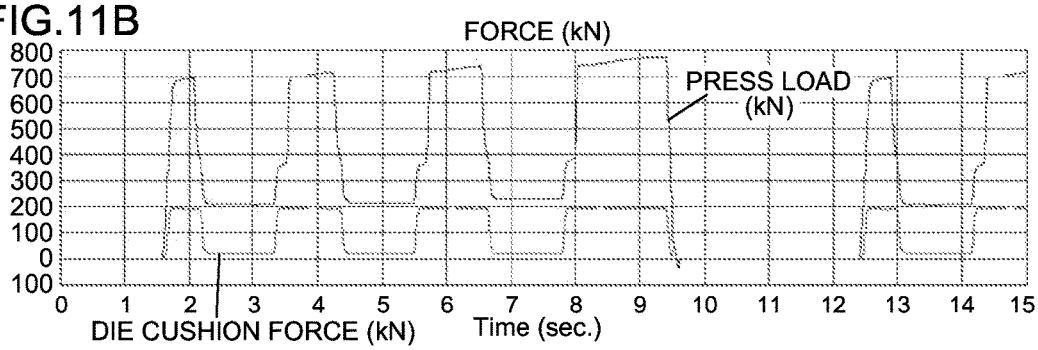
Figure 11C:
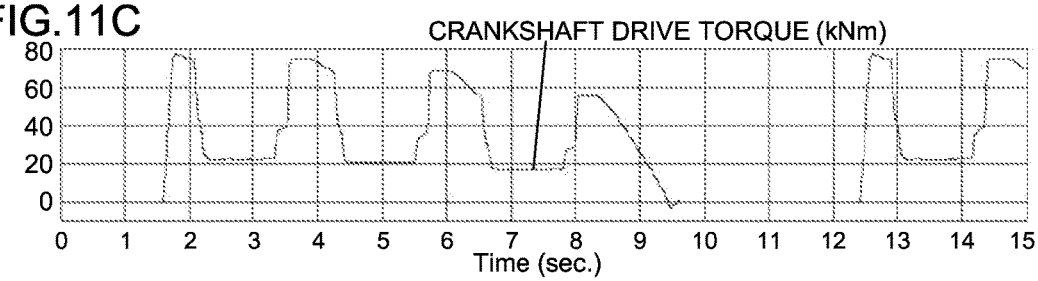
Figure 11D:
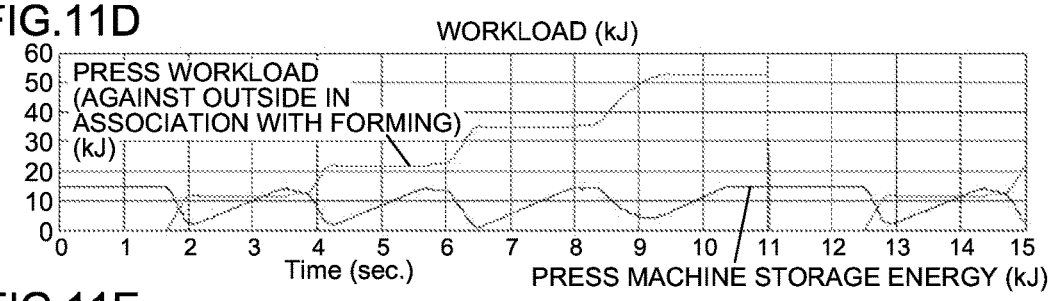
Figure 11E:
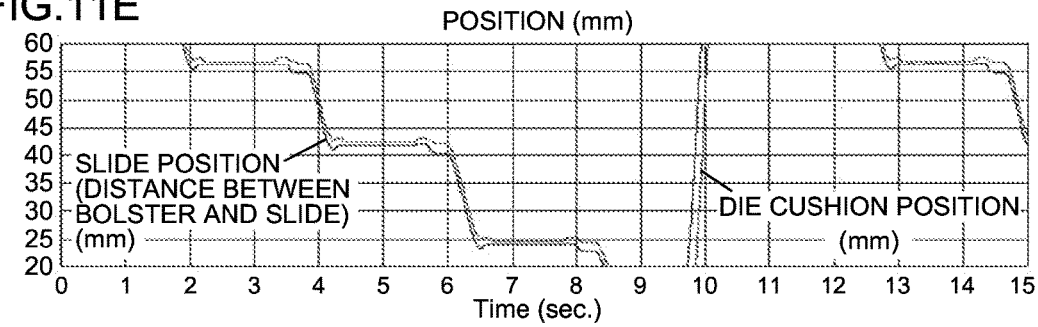

FIG. 11E is an enlarged view of waveforms showing the slide position and the die cushion position in FIG. 11A. As shown in FIG. 11E, the slide position (the sub slide position) is stopped at the position raised by the given amount immediately after the stop.

After that, when the storage energy in the energy storage device 260*a* reaches the upper limit of the energy storage amount (step S18, a lower-side waveform in FIG. 11D), and the die cushion force is restored (step S20, a lower-side waveform in FIG. 11B), the energy protection control apparatus 500A outputs a sub slide lowering command to the sub slide control apparatus 600. When the sub slide lowering command is input, the sub slide relative position command unit 612 within the sub slide position control device 610 switches the sub slide relative position command to a value for lowering the sub slide 26 by the given amount (1.5 mm), and holds the value.

The energy protection control apparatus 500A determines whether the sub slide 26 is lowered by the given amount (restored) (step S140). When determining that the sub slide 26 is lowered by the given amount (in a case of "Yes"), the energy protection control apparatus 500A outputs a slide lowering command to the slide position command unit 212. Accordingly, the slide 23 starts to be lowered (is restarted) by following the slide position command to lower the slide 23 (the main slide 24), and the forming is continued (step S22).

The processing from step S10 to step S22 is repeated until the slide 23 reaches the bottom dead center.

One cycle in the present embodiment is about 11 seconds, i.e., the time of one cycle is reduced compared to the time (15 sec) of one cycle in the first embodiment in which only the die cushion force is reduced. The reducing of time is an effect caused by: (i) in the present embodiment, degree of removing the press load is more than that in the first embodiment in which only the die cushion force is reduced; (ii) so the torque of the servo motor 40 becomes smaller than the rated torque, and thus the loss mainly including the copper loss is dramatically decreased, which means the loss (kW) is significantly smaller than the supply electricity (kW); and (iii) as a result, a recovery time of the storage energy is significantly shortened, which leads to decreasing of the slide stop time in mid-course.

In the first embodiment, the slide 23 can be raised/lowered during the intermediate stop by a sequence for controlling the servo press (a sequence enclosed by a dotted line in FIG. 6 or the like). However, there are problems that it is not appropriate to rapidly accelerate (so as to raise/lower) the slide 23 that consumes much energy so as to recover the storage energy for driving the slide 23 of the servo press, and a response is deteriorated to increase the cycle time since the crankshaft is driven as compared to the case in which the sub slide 26 is locally driven. Therefore, it is more effective to raise/lower only the sub slide 26 by the sub slide drive device 50, whereby the above problems do not occur.

Waveform diagrams shown in FIGS. 12A to 12E show a case in which the raised amount of the sub slide 26 was increased to 2 mm from 1.5 mm in the second embodiment.

Figure 12A:
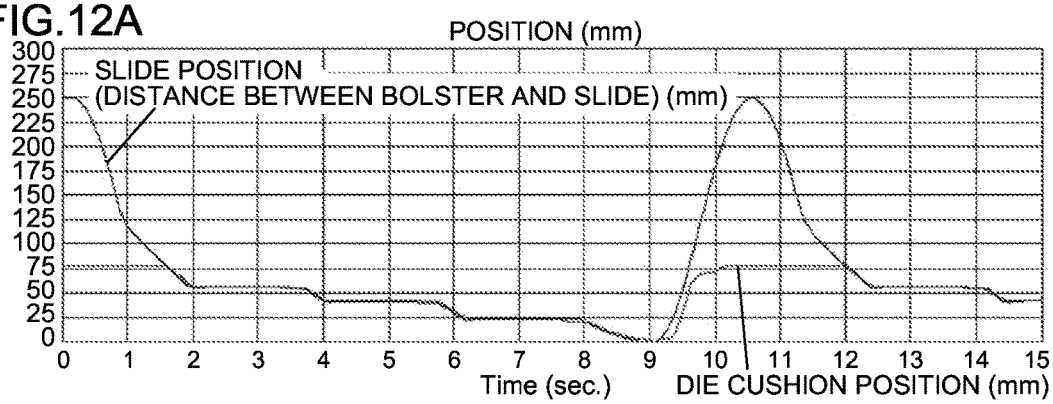
FIGS. 12A to 12E are waveform diagrams illustrating an experiment result of drawing using the servo press system according to the second embodiment, in which a sub slide is raised by 2 mm after stop.
Figure 12B:
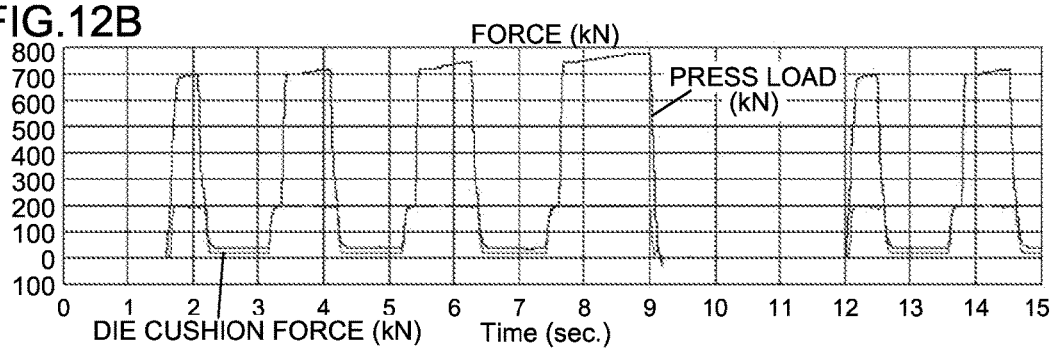
Figure 12C:
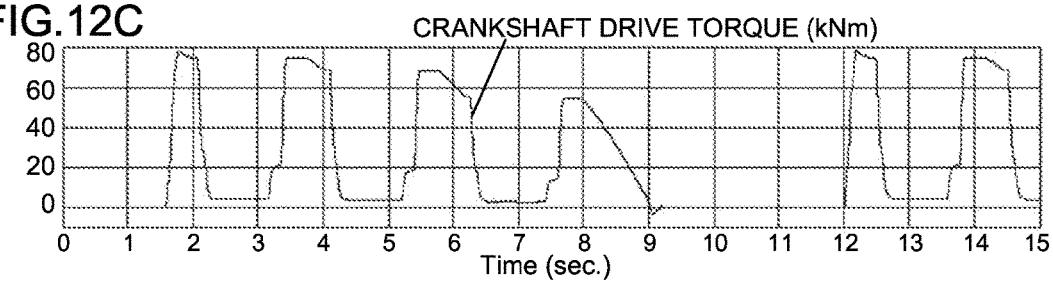
Figure 12D:
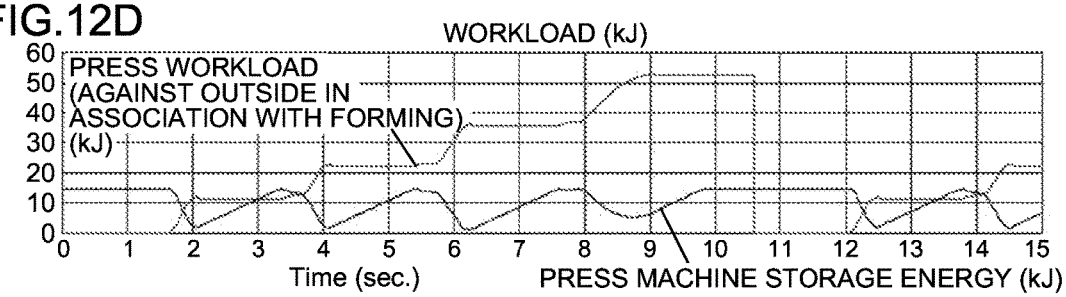
Figure 12E:
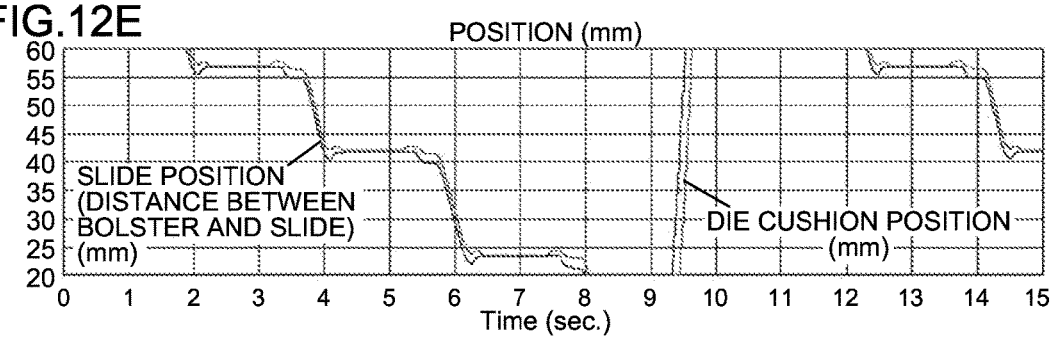

As is understood from comparison between the press load in FIG. 11B and the press load in FIG. 12B, the press load was further dramatically reduced and the cycle time was reduced by about 0.5 seconds when the sub slide 26 was raised by 2 mm as compared to the case in which the sub slide 26 was raised by 1.5 mm.

In other words, although the press load was further dramatically reduced, the cycle time was reduced only by about 0.5 seconds.

This is because the efficiency of the servo motor 40 is extremely improved (the loss is extremely reduced) when the torque applied to the servo motor 40 is below the rated value, and a loss gap therebetween is small relative to a gap in the torque value.

<Another Embodiment of the Die Cushion Force Command Unit>

Figure 13:
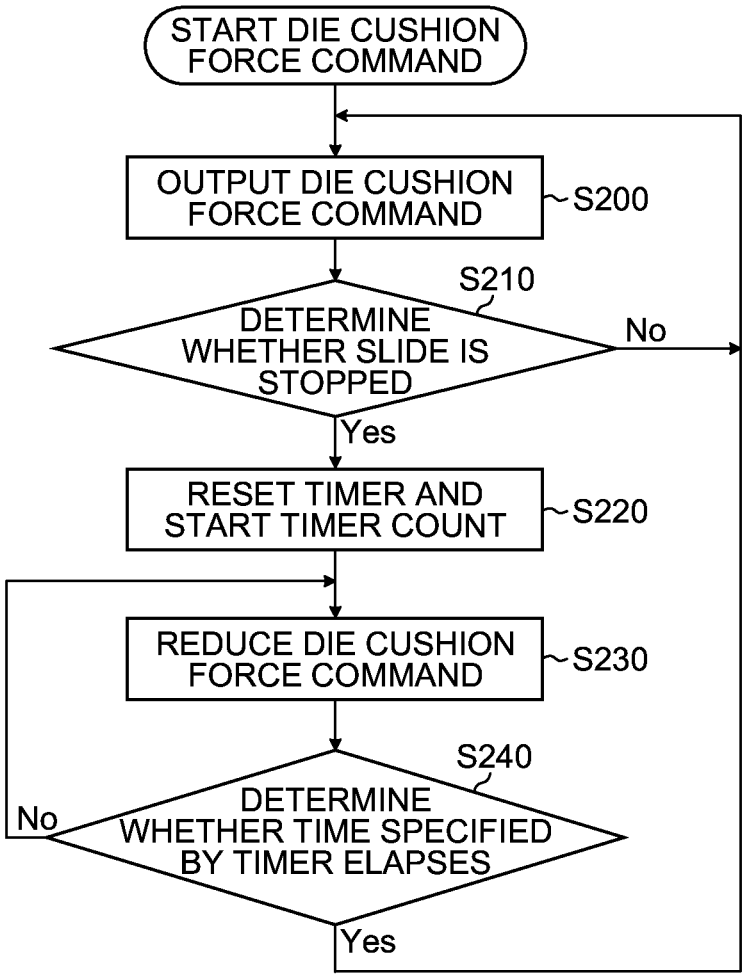
FIG. 13 is a flowchart illustrating another embodiment of a die cushion force command unit within a die cushion force control device.

FIG. 13 is a flowchart illustrating another embodiment of the die cushion force command unit 412 within the die cushion force control device 410.

As shown in FIG. 13, the die cushion force command unit according to another embodiment outputs a die cushion force command required for drawing (step S200), and thereafter determines whether the slide 23 is stopped (step S210). The slide 23 can be determined to be stopped by a slide stop detector which detects that a change in the crank angle signal of the crankshaft encoder 14 becomes 0.

When the slide 23 is stopped, a time is reset, and a timer counter is started (step S220). When the slide 23 is stopped, the die cushion force command to reduce the die cushion force is output at the same time (step S230).

After that, it is determined whether a time measured by the timer counter passes a time specified by the timer in advance (step S240). When the time specified by the timer elapses after the slide 23 is stopped (after the die cushion force is reduced), the processing proceeds to step S200, and the original die cushion force command is output.

Here, the time specified by the timer is a time for which the energy required for driving the servo press is stored in the energy storage device 260*a* by storage after the slide 23 is stopped.

[Others]

In the present embodiment, by reducing the die cushion force so as not to reach 0 at lowest, the close contact between the blank holder and the material is maintained. Accordingly, the drawing is more smoothly performed, and a formed surface is beautifully finished. However, the die cushion force may be reduced to 0 if finish of the formed surface is not taken into consideration. In this case, the press load is further reduced, and the energy saving and the shortening of the press cycle can also be enabled.

Although the die cushion force command is restored to the same die cushion force command after the die cushion force is reduced, the present invention is not limited thereto. A different die cushion force command may also be output according to the depth of the drawing.

Although the sub slide is driven by the cylinder piston mechanism constituted by the sub slide and the main slide, the present invention is not limited thereto. The sub slide may be also driven by a screw mechanism including a screw portion and a nut portion, or a rack and pinion mechanism, which are constituted by the sub slide and the main slide.

Moreover, the die cushion apparatus is not limited to one that generates the cushion force by using the hydraulic cylinder. For example, the die cushion apparatus may raise and lower the cushion pad by a screw mechanism driven by a servo motor.

It goes without saying that the present invention is not limited to the aforementioned embodiments, and various deformations can be made without departing from the spirit of the present invention.

What is claimed is:

1. A drawing method using a servo press system comprising a servo press which transmits a drive force to a slide from a servo motor via a link mechanism, and a die cushion apparatus which supports a cushion pad, and generates a die cushion force in the cushion pad, the method comprising:

a lowering step of lowering the slide in a course of a stroke for performing drawing;

a stopping step of stopping the slide for a first period before the slide reaches a bottom dead center in the course of the stroke for performing drawing;

a keeping step of reducing the die cushion force to below a predetermined die cushion force and keeping the die cushion force to below the predetermined die cushion force for a second period while the slide is stopped in the course of the stroke for performing drawing; and a restarting step of restarting the lowering of the slide after the die cushion force is kept to below the predetermined die cushion force for the second period, wherein the drawing including the lowering step, the stopping step, the keeping step, and the restarting step is performed at least one time in the course of the stroke for performing drawing.

2. The drawing method according to claim 1, wherein the die cushion force is reduced to a die cushion force at least required for maintaining close contact between a blank holder supported by the cushion pad and a material on the blank holder in the keeping step.

3. The drawing method according to claim 1, wherein the slide is stopped at a position raised by a predetermined amount after the slide is stopped in the stopping step.

4. The drawing method according to claim 3, wherein the predetermined amount is a value larger than 0 mm and smaller than 5 mm.

5. The drawing method according to claim 1, wherein the servo press includes an energy storage device which supplies electricity to the servo motor and a set of preset limits used to control the servo press system, and the first period and the second period are set corresponding to a period for which an amount of energy storage in the energy storage device is restored to a preset upper limit.

* * * * *